US012070177B2

(12) United States Patent
Udy et al.

(10) Patent No.: US 12,070,177 B2
(45) Date of Patent: Aug. 27, 2024

(54) SURFACE CLEANING HEAD FOR VACUUM CLEANER

(71) Applicant: SHARKNINJA OPERATING LLC, Needham, MA (US)

(72) Inventors: Adam Udy, Sutton (GB); Andre David Brown, Natick, MA (US); John Freese, Newton, MA (US); Patrick Cleary, Allston, MA (US); Daniel Meyer, Boston, MA (US); Daniel John Innes, West Roxbury, MA (US); Jason Thorne, Wellesley Hills, MA (US); Peter Hutchinson, Suzhou (CN); Gordon Howes, Suzhou (CN); Wenxiu Gao, Suzhou (CN); Daniel R. Der Marderosian, Westwood, MA (US); Thomas Ford, Wellesley, MA (US); Owen R. Johnson, Needham, MA (US)

(73) Assignee: SharkNinja Operating LLC, Needham, MA (US)

( * ) Notice: Subject to any disclaimer, the term of this patent is extended or adjusted under 35 U.S.C. 154(b) by 398 days.

(21) Appl. No.: 16/921,350

(22) Filed: Jul. 6, 2020

(65) Prior Publication Data

US 2020/0329930 A1 Oct. 22, 2020

Related U.S. Application Data

(60) Division of application No. 15/685,456, filed on Aug. 24, 2017, now Pat. No. 10,702,108, which is a (Continued)

(51) Int. Cl.

| | |
|---|---|
| ***A47L 5/30*** | (2006.01) |
| ***A47L 5/34*** | (2006.01) |
| ***A47L 9/04*** | (2006.01) |

(52) U.S. Cl.
CPC ..... *A47L 5/30* (2013.01); *A47L 5/34* (2013.01); *A47L 9/0411* (2013.01); (Continued)

(58) Field of Classification Search
CPC ..... A47L 5/30; A47L 5/34; A47L 9/0411; A47L 9/0444; A47L 9/0461; A47L 9/0477; A47L 9/0488
See application file for complete search history.

(56) References Cited

U.S. PATENT DOCUMENTS

| | | | |
|---|---|---|---|
| 2,032,345 | A | 3/1936 | Cranon |
| 2,411,488 | A | 11/1946 | White |

(Continued)

FOREIGN PATENT DOCUMENTS

| | | |
|---|---|---|
| CN | 201861563 U | 6/2011 |
| CN | 102188197 | 9/2011 |

(Continued)

OTHER PUBLICATIONS

UK Examination Report dated Sep. 20, 2022, received in UK Patent Application No. 1915155.4, 4 pages.

(Continued)

*Primary Examiner* — David Redding
(74) *Attorney, Agent, or Firm* — Grossman Tucker Perreault & Pfleger, PLLC

(57) ABSTRACT

A surface cleaning head includes dual rotating agitators (e.g., a leading roller and a brush roll) and a removable cover for covering a top of the agitators and allowing access to the agitators from a top of the surface cleaning head. The dual agitators may be used to facilitate capturing of debris in the air flow into a suction conduit on the underside of the surface cleaning head. The brush roll may be located in a brush roll chamber and at least partially in an opening to the suction conduit. The leading roller may be positioned adjacent to (Continued)

and in advance of the suction conduit opening such that the leading roller engages debris and moves the debris toward the brush roll and the opening. The leading roller may be removable from the housing and held in place by the removable cover. The cover may be coupled using isolated latching mechanisms.

17 Claims, 13 Drawing Sheets

Related U.S. Application Data continuation-in-part of application No. PCT/US2016/058148, filed on Oct. 21, 2016, and a continuation-in-part of application No. 15/331,045, filed on Oct. 21, 2016, now Pat. No. 11,278,171, said application No. 15/685,456 is a continuation-in-part of application No. 14/867,599, filed on Sep. 28, 2015, now Pat. No. 9,955,832.

(60) Provisional application No. 62/313,394, filed on Mar. 25, 2016, provisional application No. 62/248,813, filed on Oct. 30, 2015, provisional application No. 62/244,331, filed on Oct. 21, 2015.

(52) U.S. Cl.
CPC ..... *A47L 9/0444* (2013.01); *A47L 9/0461* (2013.01); *A47L 9/0477* (2013.01); *A47L 9/0488* (2013.01)

(56) References Cited

U.S. PATENT DOCUMENTS 2,607,062 A 8/1952 Le Febvre
2,785,431 A 3/1957 Pardee
4,138,762 A 2/1979 Jost et al.
4,173,807 A 11/1979 Maier
4,333,205 A 6/1982 Woodward et al.
4,334,337 A 6/1982 Miller et al.
4,372,004 A 2/1983 Vermillion
4,627,127 A 12/1986 Dupre
4,662,027 A 5/1987 Parker et al.
4,912,805 A 4/1990 Krasznai et al.
D348,548 S 7/1994 Pino
5,452,490 A 9/1995 Brundula et al.
5,495,634 A 3/1996 Brundula et al.
5,632,060 A 5/1997 Steinberg et al.
5,765,258 A 6/1998 Melito et al.
5,960,514 A 10/1999 Miller et al.
6,012,200 A 1/2000 Murphy et al.
D440,019 S 4/2001 Mehaffey
6,226,832 B1 5/2001 McCormick
6,237,188 B1 5/2001 Takemoto et al.
D473,687 S 4/2003 Kaffenberger
6,550,099 B2 4/2003 Worwag
7,013,528 B2 3/2006 Parker et al.
D524,498 S 7/2006 Luebbering et al.
7,171,723 B2 2/2007 Kobayashi et al.
7,200,893 B2 4/2007 Gerber et al.
7,316,050 B2 1/2008 Worwag
7,328,479 B2 2/2008 Willenbring
7,329,294 B2 2/2008 Conrad
D566,356 S 4/2008 Medema
D569,564 S 5/2008 Labarbera
D594,612 S 6/2009 Umeda
D597,268 S 7/2009 Santiago et al.
7,690,079 B2 4/2010 Boddy et al.
D619,315 S 7/2010 Ayers
7,769,490 B2 8/2010 Abramson et al.
D635,728 S 4/2011 Fjellman
7,979,952 B2 7/2011 Beskow et al.
8,037,571 B2 10/2011 Butts et al.
D655,468 S 3/2012 Karsan
D668,010 S 9/2012 Stickney et al.
8,316,503 B2 11/2012 Follows et al.
8,402,600 B2 3/2013 Beskow et al.
8,402,601 B2 3/2013 Fahlstrom
D681,291 S 4/2013 Morgan et al.
8,418,303 B2 4/2013 Kapoor et al.
8,631,541 B2 1/2014 Tran
8,726,441 B1 5/2014 Colasanti et al.
8,745,818 B2 6/2014 Iles et al.
8,776,311 B2 7/2014 Genn et al.
8,782,851 B2 7/2014 Follows et al.
8,800,107 B2 8/2014 Blouin
8,806,710 B2 8/2014 Follows et al.
D720,104 S 12/2014 Santiago et al.
9,021,655 B2 5/2015 Owen et al.
9,027,198 B2 5/2015 Conrad
D731,130 S 6/2015 Dyson et al.
D731,134 S 6/2015 Dyson et al.
D731,136 S 6/2015 Yun et al.
D731,720 S 6/2015 Gidwell et al.
D731,724 S 6/2015 Cheon et al.
9,066,640 B2 6/2015 Iles et al.
D738,583 S 9/2015 Gidwell et al.
D738,584 S 9/2015 Niedzwecki
9,144,356 B2 9/2015 Yun
D741,558 S 10/2015 Kerr
D742,083 S 10/2015 Gidwell et al.
D743,123 S 11/2015 Chu
D745,231 S 12/2015 Niedzwecki
D747,571 S 1/2016 Dyson
D747,572 S 1/2016 Kerr
9,314,140 B2 4/2016 Eriksson
D761,507 S 7/2016 Heck et al.
D762,031 S 7/2016 Niedzwecki
9,451,853 B2 9/2016 Conrad et al.
D770,111 S 10/2016 Lee et al.
9,456,723 B2 10/2016 Thorne et al.
9,468,346 B1 10/2016 Rzepka
D771,890 S 11/2016 Kim
D772,512 S 11/2016 Yoon et al.
D773,139 S 11/2016 Palladino
D774,260 S 12/2016 Manning
D774,264 S 12/2016 Bartram et al.
D779,751 S 2/2017 Chu
D779,752 S 2/2017 Johnson
D781,014 S 3/2017 Wu et al.
D788,393 S 5/2017 Canas et al.
D789,007 S 6/2017 Jang et al.
D790,785 S 6/2017 Courtney et al.
D792,665 S 7/2017 Salagnac
D796,134 S 8/2017 LaBarbera
D796,136 S 8/2017 Reynolds et al.
2002/0124334 A1* 9/2002 Worwag ..... A47L 9/0494 15/384
2003/0106183 A1 6/2003 Frederick et al.
2003/0145424 A1 8/2003 Stephens et al.
2003/0159240 A1 8/2003 Mertes et al.
2004/0045125 A1 3/2004 Park et al.
2005/0172447 A1 8/2005 Roney et al.
2006/0037170 A1 2/2006 Shimizu
2006/0191097 A1 8/2006 Baumhakel
2009/0229075 A1 9/2009 Eriksson
2010/0107359 A1 5/2010 Yoo
2010/0287717 A1 11/2010 Jang et al.
2010/0306958 A1 12/2010 Follows et al.
2011/0219571 A1 9/2011 Dyson et al.
2011/0296648 A1 12/2011 Kah, Jr.
2012/0000030 A1 1/2012 Conrad
2012/0011676 A1 1/2012 Jung
2012/0198644 A1 2/2012 Iles
2012/0169497 A1 7/2012 Schnittman
2012/0311802 A1 12/2012 Hinnat
2012/0311813 A1 12/2012 Gilbert, Jr. et al.
2013/0298350 A1 5/2013 Schnittman
2013/0139349 A1 6/2013 Iles et al.
2013/0212831 A1 8/2013 Follows et al.
2014/0060577 A1 3/2014 Bruders et al.
2014/0150202 A1 6/2014 Schultheis

(56) References Cited

U.S. PATENT DOCUMENTS

| | | | |
|---|---|---|---|
| 2014/0196247 | A1 | 7/2014 | Kasper et al. |
| 2014/0237760 | A1 | 8/2014 | Conrad |
| 2014/0259475 | A1 | 9/2014 | Doughty |
| 2014/0259521 | A1 | 9/2014 | Kowalski |
| 2015/0033498 | A1 | 2/2015 | McVey |
| 2015/0289735 | A1 | 10/2015 | Van Der Kooi et al. |
| 2015/0359396 | A1 | 12/2015 | Yun |
| 2016/0058257 | A1 | 3/2016 | Ventress et al. |
| 2016/0183749 | A1 | 6/2016 | Isley et al. |
| 2016/0220082 | A1 | 8/2016 | Thorne et al. |
| 2016/0345795 | A1 | 12/2016 | Manning |
| 2017/0079493 | A1 | 3/2017 | Genn et al. |
| 2017/0127896 | A1 | 5/2017 | Carter et al. |
| 2017/0215667 | A1 | 8/2017 | Thorne et al. |
| 2017/0231445 | A1 | 8/2017 | Kasper |
| 2017/0332859 | A1 | 11/2017 | Nam et al. |
| 2018/0199784 | A1 | 7/2018 | Schnittman et al. |

FOREIGN PATENT DOCUMENTS

| | | | |
|---|---|---|---|
| CN | 203662686 | | 6/2014 |
| CN | 104138238 | | 11/2014 |
| CN | 205181249 | U | 4/2016 |
| CN | 206080407 | U | 4/2017 |
| CN | 106963290 | | 7/2017 |
| DE | 10302525 | | 10/2006 |
| DE | 102010017211 | A1 | 12/2011 |
| DE | 102010017258 | A1 | 12/2011 |
| EP | 0042370 | | 12/1981 |
| EP | 0909547 | A2 | 4/1999 |
| EP | 1994869 | | 11/2008 |
| EP | 2289381 | A2 | 3/2011 |
| EP | 2218385 | A3 | 3/2013 |
| EP | 2543301 | | 9/2013 |
| EP | 3187083 | | 7/2017 |
| GB | 360577 | | 11/1931 |
| GB | 583738 | | 12/1946 |
| GB | 877778 | A | 9/1961 |
| GB | 2109224 | | 6/1983 |
| GB | 2285777 | A | 7/1995 |
| GB | 2476811 | | 7/2011 |
| GB | 2509925 | B | 7/2014 |
| GB | 2529819 | | 9/2016 |
| JP | S507359 | | 1/1975 |
| JP | S59174143 | U | 11/1984 |
| JP | 03228721 | A | 10/1991 |
| JP | 05228083 | A | 9/1993 |
| JP | H06248499 | A | 10/1994 |
| JP | H07322981 | A | 12/1995 |
| JP | 2639155 | B2 | 8/1997 |
| JP | H10127542 | A | 5/1998 |
| JP | H10201682 | A | 8/1998 |
| JP | H11028178 | A | 2/1999 |
| JP | H11187997 | A | 7/1999 |
| JP | 2000033059 | A | 2/2000 |
| JP | 2001120473 | A | 5/2001 |
| JP | 2003339589 | A | 12/2003 |
| JP | 2004222912 | A | 8/2004 |
| JP | 2005046262 | A | 2/2005 |
| JP | 2006247229 | A | 9/2006 |
| JP | 2006312066 | A | 11/2006 |
| JP | 2007068835 | | 3/2007 |
| JP | 2008000382 | | 1/2008 |
| JP | 2009045503 | A | 3/2009 |
| JP | 2011050428 | A | 3/2011 |
| JP | 2013013590 | A | 1/2013 |
| JP | 2013052238 | A | 3/2013 |
| JP | 2014033738 | A | 2/2014 |
| JP | 2014509211 | A | 4/2014 |
| JP | 2015000210 | | 1/2015 |
| JP | 2015116414 | A | 6/2015 |
| JP | 2016504100 | A | 2/2016 |
| JP | 2017074258 | A | 4/2017 |
| JP | 2017121468 | A | 7/2017 |
| KR | 20040052092 | A | 6/2004 |
| KR | 20050099416 | | 10/2005 |
| KR | 100593324 | B1 | 6/2006 |
| WO | 9210967 | A1 | 7/1992 |
| WO | 0141618 | A1 | 6/2001 |
| WO | 2009117383 | | 9/2009 |
| WO | 2011083294 | A1 | 7/2011 |
| WO | 2013104886 | A1 | 7/2013 |
| WO | 2014131105 | A1 | 9/2014 |
| WO | 2014131106 | A1 | 9/2014 |
| WO | 2014177216 | | 11/2014 |
| WO | 2015015166 | | 2/2015 |
| WO | 2015015167 | | 2/2015 |
| WO | 2016034848 | | 3/2016 |
| WO | 2017070492 | A1 | 4/2017 |

OTHER PUBLICATIONS

UK Examination Report dated Oct. 24, 2022, received in UK Patent Application No. 2212062.0, 4 pages.

Extended European Search Report dated Mar. 28, 2019, received in EP Application No. 16858305.2, 7 pgs.

English translation of Japanese Office Action dated May 21, 2019, received in Japanese Application No. 2018-520541, 11 pgs.

English translation of Korean Office Action dated Apr. 30, 2019, received in Korean Application No. 10-2018-7014180, 11 pgs.

U.S. Office Action dated May 3, 2019, received in U.S. Appl. No. 15/331,045, 9 pgs.

Extended European Search Report dated Apr. 3, 2019, received in EP Application No. 16858308.6, 7 pgs.

English translation of Japanese Office Action dated Apr. 1, 2019, received in Japanese Application No. 2017-557189, 6 pgs.

U.S. Office Action dated May 15, 2019, received in U.S. Appl. No. 15/492,320, 13 pgs.

PCT International Search Report and Written Opinion dated Mar. 31, 2016, received in corresponding PCT Application No. PCT/US16/15370, 15 pgs.

U.S. Office Action dated Feb. 22, 2016, received in related U.S. Appl. No. 14/744,438, 29 pgs.

Canadian Examiner Report dated Feb. 8, 2021, received in Canada Patent Application No. 3,064,747, 4 pages.

Korean Office Action with English translation dated Mar. 19, 2021, received in Korean Patent Application No. 10-2020-7006909, 15 pages.

Japanese Office Action with English translation dated Mar. 22, 2021, received in Japanese Patent Application No. 2020-510098, 15 pages.

Chinese Office Action with English translation dated Jan. 6, 2021, received in Chinese Patent Application No. 201711481216.4, 11 pages.

Japanese Office Action with English translation dated Jan. 26, received in Japanese Patent Application No. 2019-564874, 9 pages.

Chinese Office Action with English translation dated Apr. 13, 2021, received in Chinese Patent Application No. 201810516731.X, 13 pages.

Japanese Office Action with English translation dated Jan. 26, 2021, received in Japanese Patent Application No. 2019-556824, 11 pages.

Chinese Decision of Rejection dated May 7, 2021, received in China Application No. 201680061488.6, 9 pgs.

English translation of Japanese Decision of Rejection dated Jan. 6, 2020, received in Japanese Application No. 2017-557189, 5 pgs.

Chinese Office Action with English translation dated Feb. 25, 2020, received in Chinese Patent Application No. 201610921399.6, 18 pgs.

Chinese Office Action with English translation dated Mar. 2, 2020, received in Chinese Patent Application No. 201711481216.4, 16 pgs.

Chinese Office Action with English translation dated Mar. 25, 2020, received in Chinese Patent Application No. 201711405708.5, 11 pgs.

Chinese Office Action with English translation, dated Jul. 31, 2020, received in China Application No. 201610921399.6, 21 pgs.

(56) References Cited

OTHER PUBLICATIONS

Chinese Office Action with English translation, dated May 26, 2020, received in China Application No. 201810516731.X, 13 pgs.
U.S. Office Action dated Mar. 17, 2020, received in U.S. Appl. No. 15/768,879, 25 pgs.
Japanese Office Action with English translation dated Jul. 9, 2021, received in Japanese Patent Application No. 2020-080880, 8 pages.
Australian Examination Report dated May 5, 2021, received in Australian Patent Application No. 2021201726, 3 pages.
Chinese Office Action with English translation dated Aug. 31, 2021, received in Chinese Patent Application No. 202011084724.0, 8 pages.
European Extended Search Report dated Jul. 13, 2021, received in European Patent Application No. 18848114.7, 5 pages.
Korean Office Action with English translation dated Aug. 2, 2021, received in Korean Patent Application No. 10-2020-7006909, 14 pages.
Chinese Office Action with English translation dated Dec. 9, 2020, received in Chinese Patent Application No. 201711405708.5, 7 pages.
Chinese Office Action with English translation, dated May 22, 2020, received in China Applicatin No. 201810965394.2, 20 pgs.
Korean Office Action with English translation, dated Aug. 31, 2020, received in Korean Application No. 10-2020-7018384, 7 pgs.
Chinese Office Action with English translation, dated Oct. 15, 2020, received in China Application No. 201610921399.6, 21 pgs.
Australian Examination Report dated Jun. 11, 2020, received in Australian Application No. 2019246800, 7 pgs.
European Search Report dated Nov. 27, 2020, received in EP Application No. 18806820.9, 7 pgs.
U.S. Office Action dated Sep. 1, 2020, received in U.S. Appl. No. 15/492,320, 14 pgs.
U.S. Office Action dated Nov. 2, 2020, received in U.S. Appl. No. 15/987,589, 15 pgs.
U.S. Office Action dated May 21, 2020, received in U.S. Appl. No. 15/331,045, 14 pgs.
Japanese Office Action with English translation, dated Jan. 21, 2021, received in JP Application No. 2017-557189, 27 pgs.
U.S. Office Action dated Dec. 16, 2021, received in U.S. Appl. No. 15/492,320, 17 pages.
Korean Office Action with machine translation dated Jan. 18, 2022, received in Korean Patent Application No. 10-2019-7034239, 10 pages.
Chinese Office Action with English Machine Translation dated Jun. 28, 2022, received in Chinese Patent Application No. 202111186082.X, 14 pages.
U.S. Office Action dated Aug. 10, 2022, received in U.S. Appl. No. 15/492,320, 15 pages.
Chinese Office Action with English Machine Translation dated Aug. 10, 2022, received in Chinese Patent Application No. 202110712842.X, 20 pages.
English translation of Japanese Office Action dated Dec. 2, 2019, received in JP Application No. 2018-520541, 6 pgs.
English trnaslation of Korean Office Action dated Nov. 27, 2019, received in Korean Application No. 10-2018-7014180, 5 pgs.
U.S. Office Action dated Oct. 23, 2019, received in U.S. Appl. No. 15/492,320, 14 pgs.
PCT Search Report and Written Opinion dated Dec. 26, 2018, received in PCT Application No. PCT/US18/47525, 14 pgs.
Australian Examination Report dated Oct. 23, 2018, received in AU Application No. 2016341998, 5 pgs.
Australian Examination Report dated Oct. 16, 2018, received in AU Application No. 2016342001, 5 pgs.
Chinese Office Action with English translation dated Jan. 2, 2020, received in Chinese Application No. 201680061488.6, 11 pgs.
PCT Search Report and Written Opinion dated Aug. 23, 2018, received in PCT Application PCT/US18/34320, 11 pgs.
PCT Search Report and Written Opinion dated Jul. 18, 2018, received in PCT Application No. PCT/US18/28635, 16 pgs.
English translation of Korean Office Action dated May 31, 2019, received in Korean Application 10-2018-7014186, 8 pgs.
Chinese Office Action with English translation dated Feb. 18, 2022, received in Chinese Application No. 202110712842.X, 13 pages.
UK Examination Report dated Mar. 30, 2022, received in UK Application No. GB191515.4, 5 pages.
3rd Party Observation filed Jul. 13, 2020 in EP Application No. 20160744107, 7 pgs.
International Search Report and Written Opinion dated Mar. 17, 2017 in corresponding PCT Patent Application No. PCT/US 16/58155, 12 pgs.
International Search Report and Written Opinion dated Mar. 24, 2017 in corresponding PCT Patent Application No. PCT/US 16/58148, 14 pgs.
Australian Examination Report dated Jun. 24, 2021, received in Australian Patent Application No. 2021201452, 6 pages.
Chinese Decision of Rejection with English translation dated Jun. 8, 2021 received in Chinese Patent Application No. 201711405708.5, 6 pages.
Office Action dated May 3, 2021, received in Canadian Patent Application No. 3,073,677, 6 pages.
Chinese Office Action with English summary dated Dec. 26, 2022, received in Chinese Patent Application No. 202210063972X, 10 pages.
U.S. Office Action dated Feb. 23, 2023, received in U.S. Appl. No. 17/556,992, 14 pages.
Chinese Office Action with English translation dated Oct. 18, 2022, received in Chinese Patent Application No. 202210128813.3, 14 pages.
Australian Examination Report dated Nov. 15, 2022, received in Australian Patent Application No. 2021232679, 5 pages.
Chinese Second Office Action with English Summary issued May 10, 2023, received in Chinese Patent Application No. 202111186082.X, 17 pages.
Chinese Office Action with machine generated English translation issued May 27, 2023, received in Chinese Patent Application No. 202210128813.3, 19 pages.
Chinese Office Action with English Summary issued Jun. 19, 2023, received in Chinese Patent Application No. 201711405708.5, 10 pages.
Chinese Office Action with English Summary issued Jul. 15, 2023, received in Chinese Patent Application No. 202210063972X, 16 pages.
Australian Examination Report issued Nov. 3, 2023, received in Australian Patent Application No. 2021232679, 3 pages.
Australian Examination Report issued Nov. 17, 2023, received in Australian Patent Application No. 2022204276, 3 pages.
Australian Examination Report issued Aug. 31, 2023, received in Australian Patent Application No. 2022202981, 4 pages.
US Office Action issued Jun. 7, 2024, received in U.S. Appl. No. 18/519,793, 9 pages.

* cited by examiner

SURFACE CLEANING HEAD FOR VACUUM CLEANER

CROSS-REFERENCE TO RELATED APPLICATIONS

The present application is a continuation-in-part of U.S. patent application Ser. No. 15/331,045, filed Oct. 21, 2016, which claims the benefit of U.S. Provisional Patent Application Ser. No. 62/244,331 filed Oct. 21, 2015, U.S. Provisional Patent Application Ser. No. 62/248,813 filed Oct. 30, 2015, and U.S. Provisional Patent Application Ser. No. 62/313,394 filed Mar. 25, 2016, now U.S. Pat. No. 11,278,171, issued Mar. 22, 2022, all of which are fully incorporated herein by reference. The present application is also a continuation-in-part of International Application No. PCT/US2016/058148, filed on Oct. 21, 2016, which is fully incorporated herein by reference. The present application is also a continuation-in-part of U.S. patent application Ser. No. 14/867,599, filed Sep. 28, 2015, which is incorporated herein by reference.

TECHNICAL FIELD

The present disclosure relates to vacuum cleaners and more particularly, to a vacuum cleaner surface cleaning head with dual agitators such as a leading roller and a brush roll.

BACKGROUND INFORMATION

Vacuum cleaners generally include a suction conduit with an opening on the underside of a surface cleaning head for drawing air (and debris) into and through the surface cleaning head. One of the challenges with vacuum cleaner design is to control engagement of the suction conduit with a surface being cleaned to provide the desired amount of suction. If the suction conduit is spaced too far from a surface, the suction may be less because the air is flowing into the suction conduit through a greater surface area. If the suction conduit is directly engaged with the surface and thus sealed on all sides, air will stop flowing into the suction conduit and the suction motor may be damaged as a result.

Vacuum cleaners also generally use agitation to loosen debris and facilitate capturing the debris in the flow of air into the suction conduit. Agitators are often used in the suction conduit of a surface cleaning head proximate a dirty air inlet to cause the agitated debris to flow into the dirty air inlet. If the agitator in the suction conduit is unable to loosen the debris or if the debris is too small, the suction conduit may pass over the debris without removing the debris from the surface. In other cases, the surface cleaning head may push larger debris forward without ever allowing the debris to be captured in the flow into the suction conduit (sometimes referred to as snowplowing). A rotating agitator may also cause the debris to circulate without being captured in the air flow into the dirty air inlet.

One example of an agitator is a cleaning roller such as a brush roll. A cleaning roller may be located within a suction conduit and/or may be located at a leading side of a suction conduit (e.g., a leading roller). One challenge with cleaning rollers is the ability to access the cleaning rollers, for example, to remove debris and/or replace the cleaning rollers. Other challenges include accommodating two cleaning rollers within the housing and driving the two cleaning rollers.

SUMMARY

Consistent with an embodiment, a surface cleaning head includes a housing having a front side, a back side, a first lateral side and a second lateral side. The housing defines a suction conduit with a suction conduit opening on an underside of the housing between the front side and the back side. The surface cleaning head also includes a brush roll rotatably mounted to the housing within a brush roll chamber and a leading roller mounted to the housing in front of the brush roll. The suction conduit passes through the brush roll chamber and at least a portion of the brush roll is proximate the opening of the suction conduit. A removable cover is removably coupled to the housing for covering the brush roll chamber and the brush roll and at least partially covering the leading roller.

Consistent with another embodiment, a surface cleaning head includes a housing having a front side, a back side, a first lateral side and a second lateral side. The surface cleaning head also includes a brush roll rotatably mounted to the housing within a brush roll chamber and having a first brush roll end proximate the first lateral side and a second brush roll end proximate the second lateral side. The surface cleaning head further includes a leading roller mounted to the housing in front of the brush roll and having a first leading roller end proximate the first lateral side and a second leading roller end proximate the second lateral side. A drive mechanism is coupled to the first brush roll end for rotating the brush roll, and the second brush roll end of the brush roll is coupled to the second leading roller end of the leading roller for transferring rotation from the brush roll to the leading roller. The drive mechanism includes a drive motor.

Consistent with a further embodiment, a surface cleaning head includes a housing having a front side and a back side and defining a brush roll chamber and a suction conduit with a suction conduit opening on an underside of the housing between the front side and the back side. The suction conduit passes from the suction conduit opening through at least a portion of the brush roll chamber. The surface cleaning head also includes a brush roll rotatably mounted to the housing within the brush roll chamber with at least a portion of the brush roll being proximate the opening of the suction conduit and a vacuum channel extending from a back side of the brush roll chamber such that the suction conduit passes from the brush roll chamber and into the vacuum channel. A shelf structure is located at the back side of the brush roll chamber and includes a surface facing generally downward toward the underside of the housing and opposing rotation of the brush roll. The shelf structure is configured and positioned to knock down and de-energize debris moving at the back side of the brush roll chamber to allow the debris to enter the vacuum channel via air flow through the suction conduit.

Consistent with yet another embodiment, a surface cleaning head includes a housing having a front side and back side and defining a brush roll chamber and a suction conduit with a suction conduit opening on an underside of the housing between the front side and the back side. The suction conduit passes through at least a portion of the brush roll chamber. The surface cleaning head also includes wheels coupled to the housing for supporting the housing on a surface to be cleaned, a brush roll rotatably mounted to the housing within the brush roll chamber with at least a portion of the brush roll extending through the suction conduit opening, and a leading roller mounted to the housing in front of the brush roll. The surface cleaning head further includes at least one floor sealing strip along a rear side of the suction conduit opening and along at least a portion of sides of the suction conduit opening. Side air passageways are formed between the leading roller and ends of the at least one floor sealing strip on the sides of the suction conduit. A sole plate on an underside of the housing defines at least a portion of the suction conduit opening and has a clearance from the surface to be cleaned when the wheels are supported on the surface to be cleaned. The brush roll extends beyond the sole plate less than or equal to the clearance and the at least one floor sealing strip extends greater than the clearance.

BRIEF DESCRIPTION OF THE DRAWINGS

These and other features and advantages will be better understood by reading the following detailed description, taken together with the drawings wherein.

DETAILED DESCRIPTION

Figure 1:
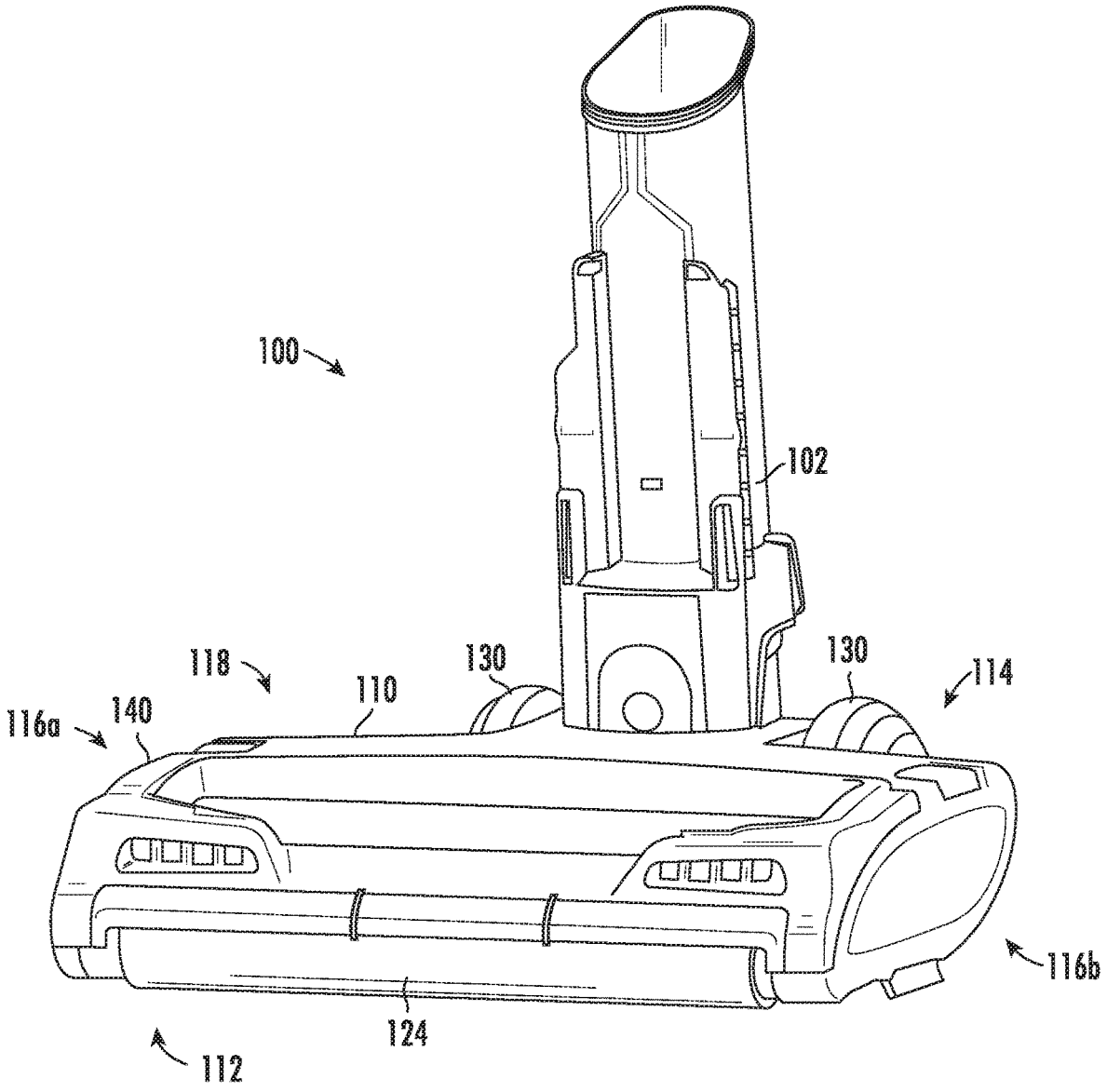
FIG. 1 is a top perspective view of a surface cleaning head including dual agitators, consistent with an embodiment of the present disclosure.

A surface cleaning head, consistent with some embodiments of the present disclosure, includes dual rotating agitators (e.g., a leading roller and a brush roll) and a removable cover for covering a top of the agitators and allowing access to the agitators from a top of the surface cleaning head. The dual agitators may be used to facilitate capturing of debris in the air flow into a suction conduit on the underside of the surface cleaning head. The brush roll may be located in a brush roll chamber and at least partially in an opening to the suction conduit. The leading roller may be positioned adjacent to and in advance of the suction conduit opening such that the leading roller engages debris and moves the debris toward the brush roll and the opening. The leading roller may be removable from the housing and held in place by the removable cover. The removable cover may be coupled to the housing of the surface cleaning head using one or more latching mechanisms that are isolated from the brush roll chamber. A surface cleaning head may also include a drive mechanism that drives a brush roll at one end with the brush roll transferring rotation to a leading roller at the other end.

In other embodiments, a surface cleaning head includes a brush roll in a brush roll chamber and a shelf structure at a back side of the brush roll chamber to knock down and de-energize debris and facilitate movement of the debris into a vacuum channel extending from the back side of the brush roll chamber. The vacuum channel may include a flared mouth in communication with the brush roll chamber with at least a portion of the shelf structure extending into the flared mouth.

In further embodiments, a surface cleaning head may include features for improving air flow into a suction conduit. A surface cleaning head may include sealing strips on an underside around at least a portion of an opening to the suction conduit, forming side air passageways between the sealing strips and a leading roller. A surface cleaning head may provide a sole plate clearance sufficient to provide a desired carpet engagement by a brush roll and may have bristle strips extending from the underside to provide desired sealing on a hard wood floor. A surface cleaning head may also include a bleed valve with an actuator capable of being actuated by a pull stroke of the surface cleaning head to lower suction and facilitate maneuverability.

Although various features and concepts are described in the context of an example embodiment of a surface cleaning head, other embodiments of the surface cleaning head are within the scope of the present disclosure and the features and concepts described herein may be used in other embodiments of a surface cleaning head either alone or in combination. Embodiments of the surface cleaning head may be used in different types of vacuum cleaners including, without limitation, an "all in the head" type vacuum, upright vacuum cleaners, canister vacuum cleaners, stick vacuum cleaners, robotic vacuum cleaners and central vacuum systems.

As used herein, a "surface cleaning head" refers to a device configured to contact a surface for cleaning the surface by use of suction air flow, agitation, or a combination thereof. A surface cleaning head may be pivotably or steeringly coupled by a swivel connection to a wand for controlling the surface cleaning head and may include motorized attachments as well as fixed surface cleaning heads. A surface cleaning head may also be operable without a wand or handle. As used herein, "seal" or "sealing" refers to preventing a substantial amount of air from passing through to the suction conduit but does not require an air tight seal. As used herein, "agitator" refers to any element, member or structure capable of agitating a surface to facilitate movement of debris into a suction air flow in a surface cleaning head. As used herein, "soft" and "softer" refer to the characteristics of a cleaning element being more compliant or pliable than another cleaning element. As used herein, the term "flow path" refers to the path taken by air as it flows into a suction conduit when drawn in by suction. As used herein, the terms "above" and "below" are used relative to an orientation of the surface cleaning head on a surface to be cleaned and the terms "front" and "back" are used relative to a direction that a user pushes the surface cleaning head on a surface being cleaned (i.e., back to front). As used herein, the term "leading" refers to a position in front of at least another component but does not necessarily mean in front of all other components.

Referring to FIGS. 1-4, a surface cleaning head 100, consistent with embodiments of the present disclosure, is shown and described. The surface cleaning head 100 includes a housing 110 with a front side 112, a back side 114, first and second lateral sides 116*a*, 116*b*, an upper side 118, and a lower or under side 120. The housing 110 defines a suction conduit having an opening 111 on the underside 120 of the housing 110 (shown in FIGS. 2 and 4). The suction conduit is the interior space defined by interior walls in the housing 110, which receives and directs air drawn in by suction, for example, by a suction motor (not shown) either in the surface cleaning head 100 or another location in the vacuum. The suction conduit opening 111 is where the suction conduit meets the underside 120 of the housing 110.

The surface cleaning head 100 includes dual rotating agitators 122, 124, for example, a brush roll 122 and a leading roller 124. Although the example embodiment includes dual agitators, some of the features and concepts described herein may also be used in a surface cleaning head with only a single agitator or with more than two agitators. The brush roll 122 and leading roller 124 may be configured to rotate about first and second rotating axes. The rotating brush roll 122 is located in a brush roll chamber 119, and the leading roller 124 is positioned in front of and spaced from the brush roll 122. The brush roll chamber 119 defines a portion of the suction conduit and the brush roll 122 is located at least partially in the suction conduit opening 111. Thus, the brush roll 122 is located in the primary air flow path into the suction conduit opening 111.

The leading roller 124 is generally located in advance of and outside of the suction conduit opening 111, but at least a portion of the leading roller 124 may be exposed to a primary air flow into the suction conduit opening 111. In some embodiments, at least an inside upper portion (e.g., upper half) of the leading roller 124 is not exposed to the primary air flow path into the opening 111 of the suction conduit while at least an inside of the bottom portion of the leading roller 124 is exposed to the primary flow path into the opening 111 of the suction conduit. Other variations are possible where different portions of the leading roller 124 may be exposed or not exposed to the flow path into the suction conduit. In other embodiments, for example, a flow path may allow air to flow over the upper portion of the leading roller 124.

The rotating brush roll 122 may have bristles, fabric, or other cleaning elements, or any combination thereof around the outside of the brush roll 122. Examples of brush rolls and other agitators are shown and described in greater detail in U.S. Pat. No. 9,456,723 and U.S. Patent Application Pub. No. 2016/0220082, which are fully incorporated herein by reference. One example of the rotating brush roll 122 may include a combination of shorter stiffer bristles for engaging a carpet and longer softer bristles for engaging a hard surface. In particular, the rotating brush roll 122 may include one or more arrangements or groups of the shorter stiffer bristles and one or more arrangements or groups of the longer softer bristles, wherein the longer softer bristles are longer and softer as compared to the shorter stiffer bristles.

The leading roller 124 may be selected to be substantially softer than that of the brush roll 122. The softness, length, diameter, arrangement, and resiliency of the bristles and/or pile of the leading roller 124 may be selected to form a seal with a hard surface, whereas the bristles of the brush roll 122 may selected to agitate carpet fibers or the like. Softness may be determined, for example, based on the pliability of the bristles or pile being used. The leading roller 124 may also have an outside diameter that is smaller than the outside diameter of the brush roll 122. Examples of leading rollers 124 including sizes and the material used are described in greater detail in U.S. Patent Application Pub. No. 2017/0127896, which is fully incorporated herein by reference.

The leading roller 124 may include a relatively soft material (e.g., soft bristles, fabric, felt, nap or pile) arranged in a pattern (e.g., a spiral or helical pattern) to facilitate capturing debris. In one example, a thin helical strip of stiffer, longer bristles may be used together with a wider helical strip of softer bristles. Rotation of the leading roller 124 with the helical strip of stiffer, longer bristles may thus create a moving air channel that facilitates capturing of debris. In this example, the softer bristles may include nylon bristles having a length in a range of 4 to 12 mm and a diameter less than 0.08 mm. An example of longer, stiffer bristles includes nylon bristles having a length in a range of 6 to 16 mm and a diameter in a range of 0.06 to 0.20 mm.

The surface cleaning head 100 may also include a combing unit 129 with combing protrusions or teeth engaging the leading roller 124 for removing hair and other similar debris from the leading roller 124. Examples of a combing unit are described in greater detail in U.S. Patent Application Pub. No. 2017/0127896 and U.S. patent application Ser. No. 15/492,320, which are fully incorporated herein by reference.

The surface cleaning head 100 includes one or more wheels 130, 132, 134 for supporting the housing on a surface to be cleaned. In the illustrated embodiment, for example, larger rear wheels 130 are disposed proximate the back side 114 with smaller rear wheels 132 disposed therebetween on the underside 116 of the housing 110 and smaller forward wheels 134 are disposed on the underside 120 of the housing 110 proximate the front side 112. Other wheel configurations may also be used. The wheels 130, 132, 134 may provide the primary contact with the surface being cleaned and facilitate moving the surface cleaning head 100 along the surface to be cleaned. The larger rear wheels 130 may also allow the user to easily tilt or pivot the surface cleaning head 100 (e.g., brush roll 122 and/or the leading roller 124) off of the surface to be cleaned. When the surface cleaning head 100 is positioned on the surface being cleaned, the leading roller 124 may also rest on the surface being cleaned, as will be described in greater detail below.

Figure 2:
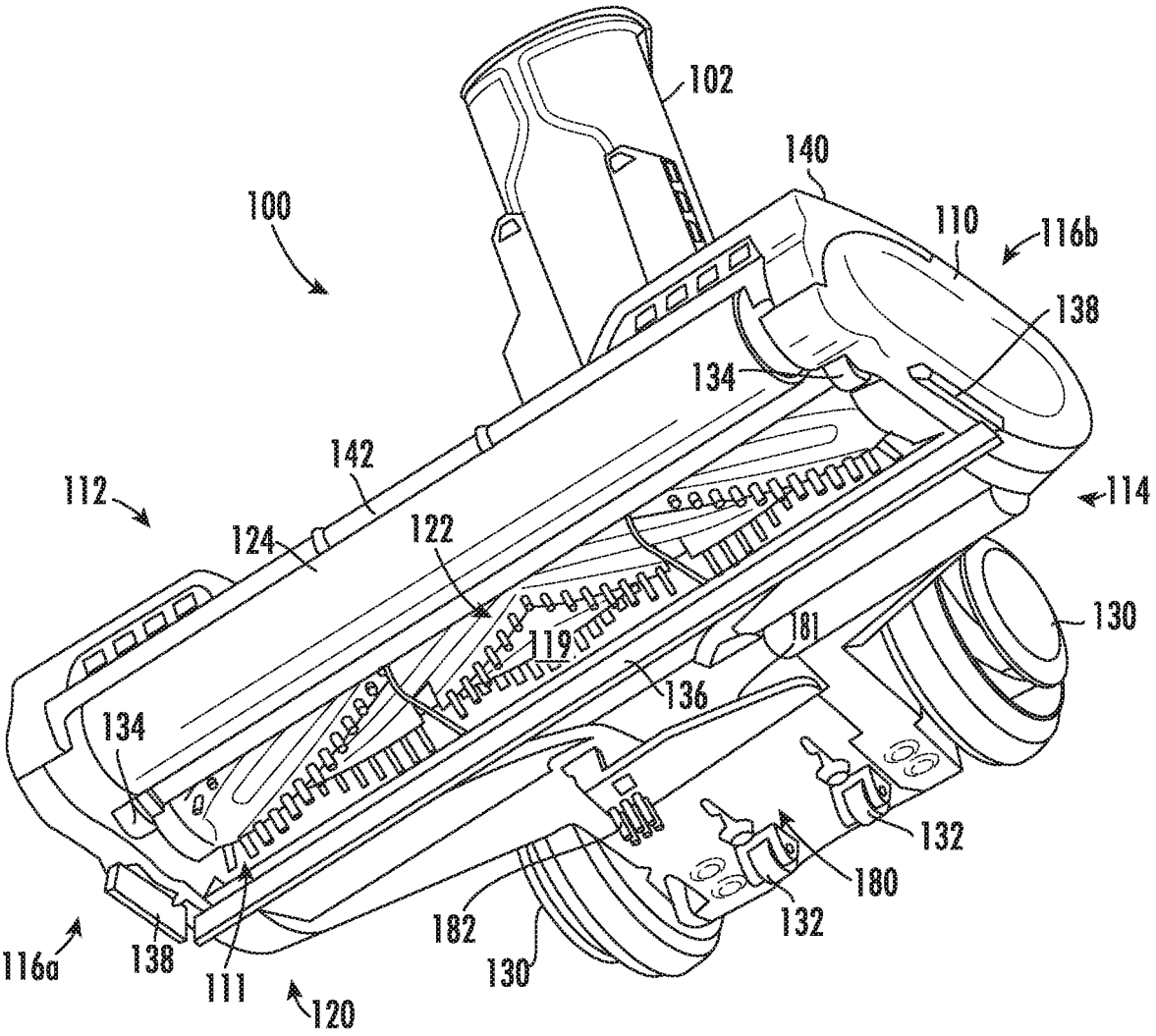
FIG. 2 is a bottom perspective view of the surface cleaning head shown in FIG. 1.
Figure 3:
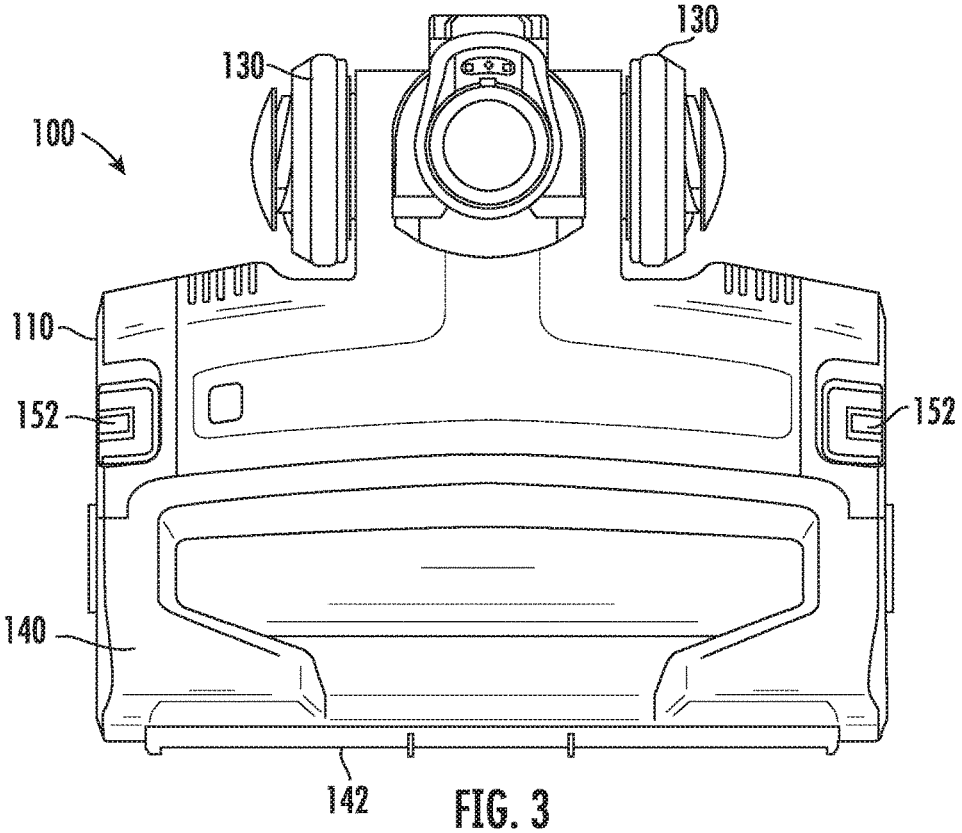
FIG. 3 is a top view of the surface cleaning head shown in FIG. 1.
Figure 4:
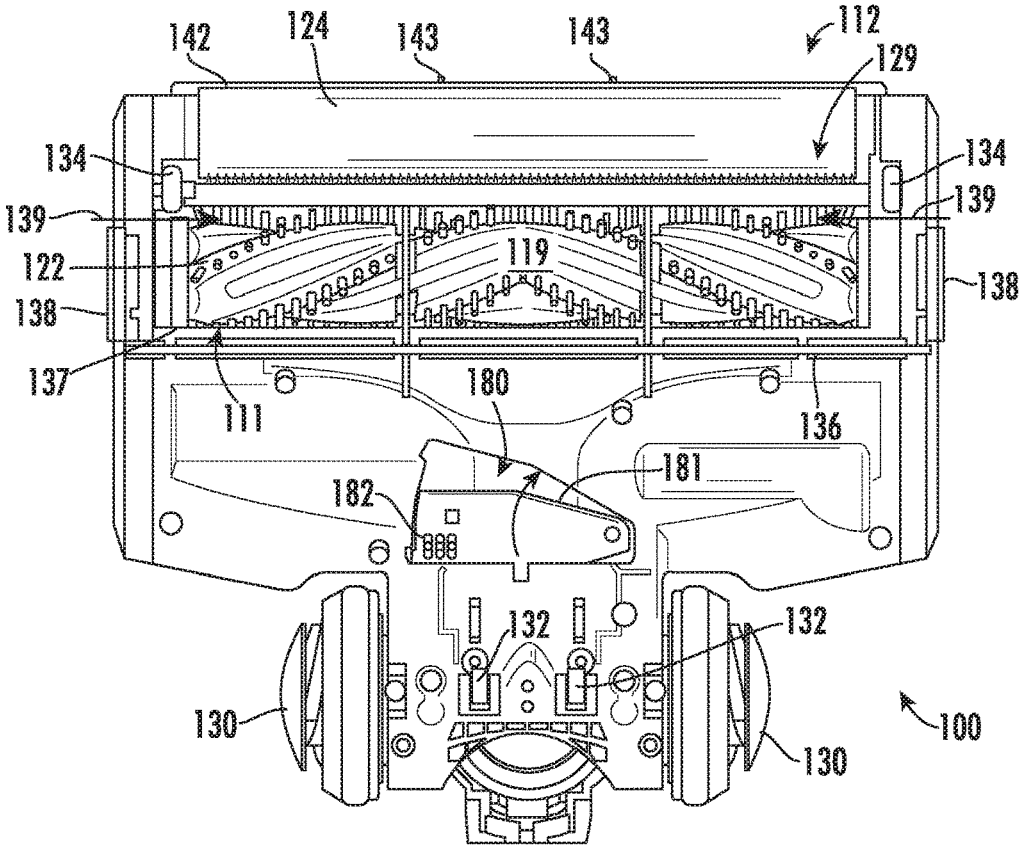
FIG. 4 is a bottom view of the surface cleaning head shown in FIG. 1.
Figure 10:
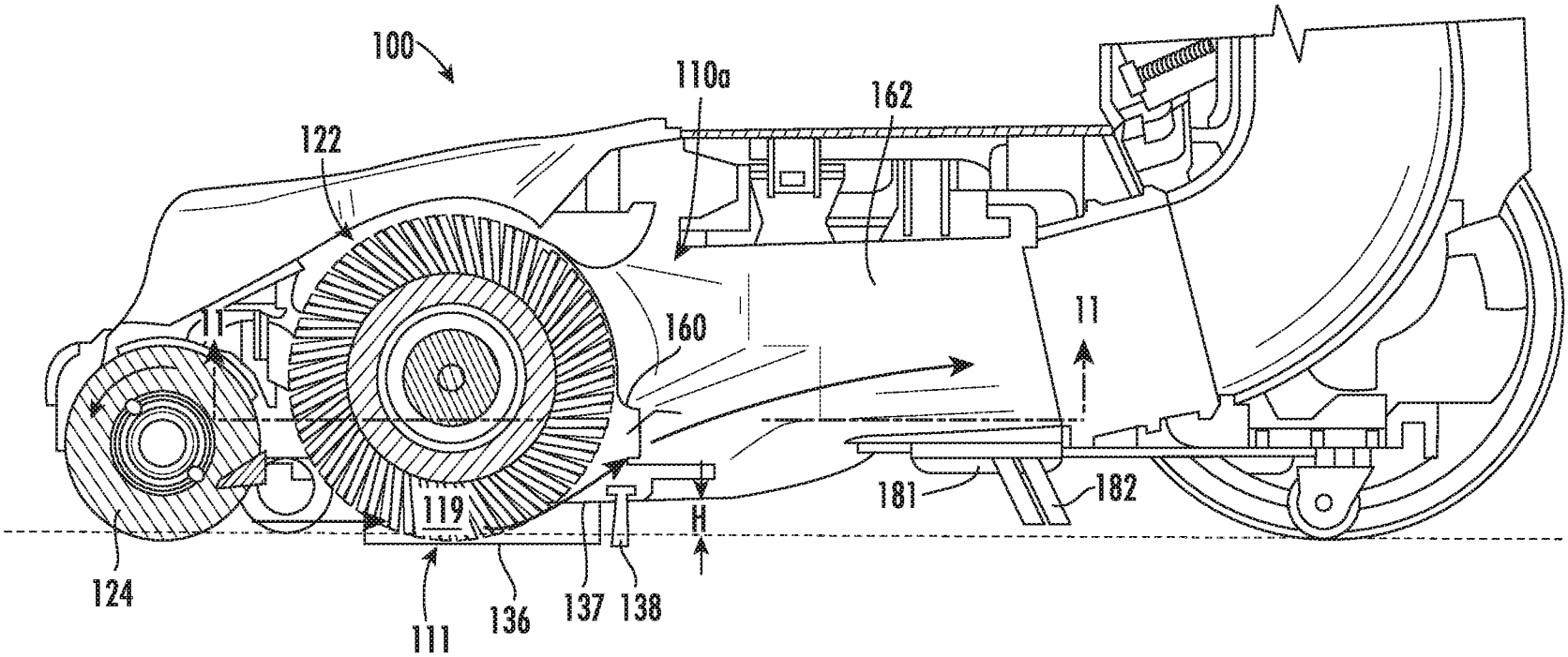
FIG. 10 is a side cross-sectional view of the surface cleaning head shown in FIG. 1 illustrating a shelf structure at a back side of a brush roll chamber.

The surface cleaning head 100 also includes one or more floor sealing strips 136, 138 on the underside 120 of the housing 110 to facilitate sealing against a surface being cleaned (e.g., a hard surface) and to help direct air to the suction conduit opening 111 (see FIGS. 2, 4 and 10). The floor sealing strips 136, 138 may include bristle strips formed by soft bristles or may include fabric material, rubber material, or other material capable of contacting the surface being cleaned to substantially prevent air flow into the suction conduit opening 111. The sealing strips 136, 138 may also include a combination of elements or materials, such as bristles with a cloth or rubber strip extending along the strip between the bristles (e.g., with the bristles being longer) to improve sealing.

The floor sealing strips 136, 138 may include one or more sections extending downward from the housing 110 and having a length sufficient to contact a hard surface being cleaned when the surface cleaning head 100 is supported on the hard surface. In one embodiment, as shown in FIG. 10, the sealing strips 136, 138 have a length that is greater than the clearance or height H of the sole plate 137 to allow more sealing on a hard surface. The clearance or height H of the sole plate 137 and the extent to which the brush roll 122 extends beyond the sole plate allow good carpet engagement with the brush roll 122 but with minimal brush roll engagement of a hard surface. Thus, the brush roll 122 extends beyond the sole plate 137 at or less than the clearance or height H of the sole plate 137 and the floor sealing strips 136, 138 extend at or greater than the clearance or height H of the sole plate 137. In one example, the clearance or height H of the sole plate 137 is in a range of 1.5 to 7.0 mm, the brush roll 122 extends beyond the sole plate in a range of 3 to 6 mm, and the floor sealing strips 136, 138 extend in a range of 5 to 10 mm.

In the illustrated embodiment shown in FIG. 2, the sealing strips 136, 138 are arranged to provide sealing around a portion of the suction conduit opening 111 while also providing side air passageways as shown by arrows 139. The rear sealing strip 136 extends along a rear side of the suction conduit opening 111 and the side sealing strips 138 extend from the rear sealing strip 136 along at least a portion of the sides of the suction conduit opening 111. Although separate sealing strips are shown, a single sealing strip may extend along both the sides and rear of the suction conduit opening. The leading roller 124 provides sealing along a front side of the suction conduit opening 111 and the space between the side sealing strips 138 and the leading roller 124 defines the side air passageways 139, thereby causing directed air flow into the suction conduit opening 111 at a location that facilitates capturing debris in the air flow (e.g., between the brush roll 122 and the leading roller 124). An increased speed of the air flow directed through the side air passageways 139 also enhances edge cleaning. In the illustrated embodiment, the side sealing strips 138 extend just short of the suction conduit opening 111 to form side air passageways 139 directed laterally toward the opening 111. Other configurations of the sealing strips 136, 138 are also contemplated, for example, the side sealing strips 138 may be longer or shorter.

Figure 5:
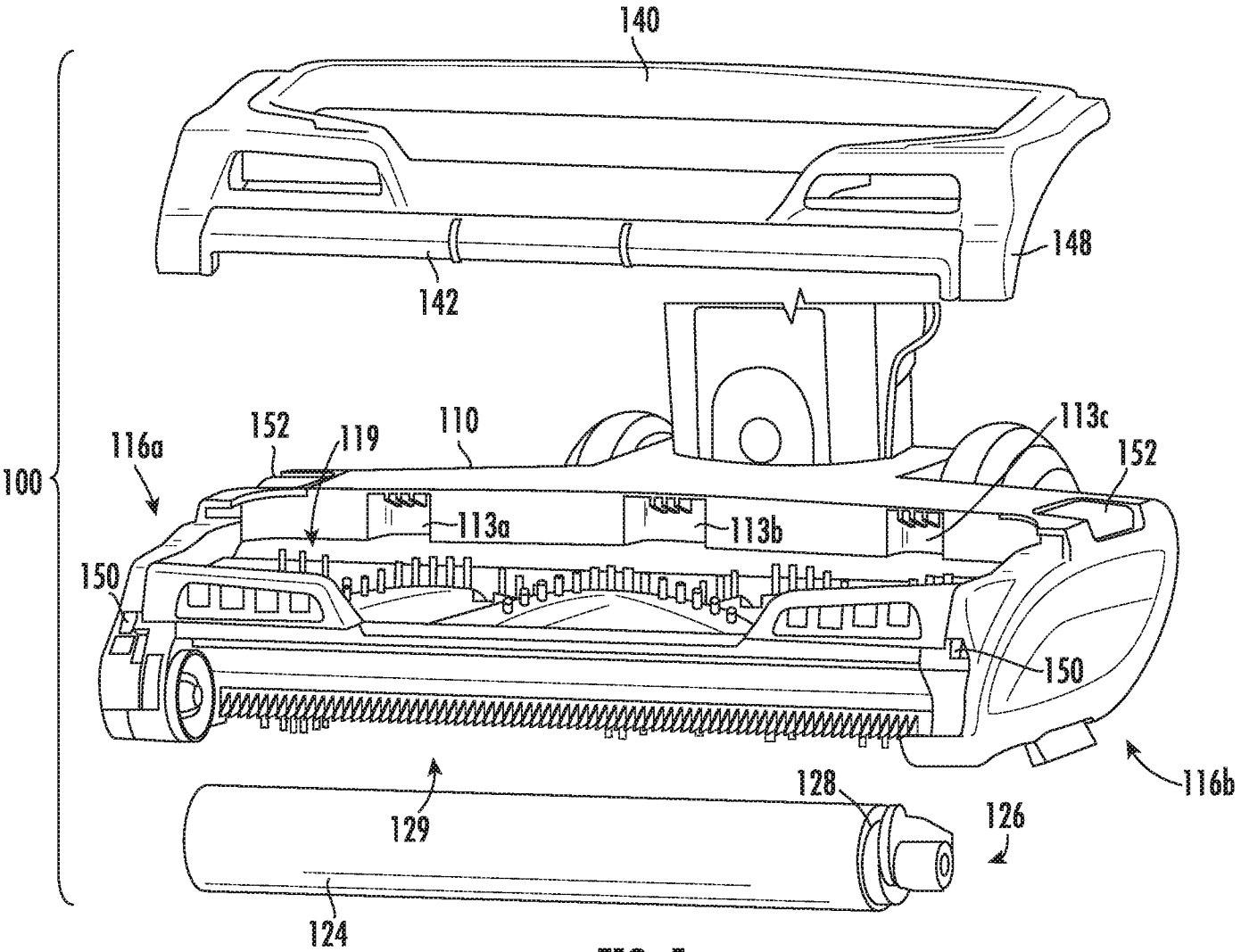
FIG. 5 is an exploded view of the surface cleaning head shown in FIG. 1 showing a removable cover and a leading roller removed from a housing.
Figure 6:
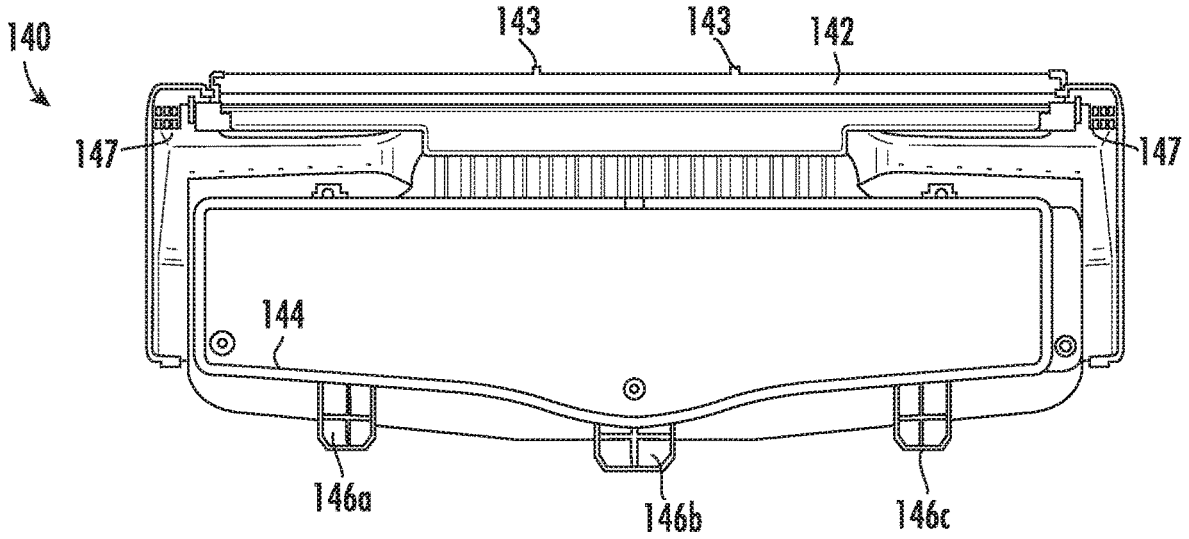
FIG. 6 is a bottom view of the removable cover shown in FIG. 5.

In an embodiment, the surface cleaning head 100 includes a removable cover 140 coupled to the housing 110 and covering a top of the agitators 122, 124, as shown in FIGS. 5 and 6. The cover 140 is removable to allow access to the agitators 122, 124 for cleaning debris tangled on the agitators 122, 124 and/or removing the agitators. The cover 140 covers the brush roll chamber 119 and brush roll 122 and covers a top portion of the leading roller 124 leaving a front of the leading roller 124 exposed. Removing the cover 140 allows access to the brush roll 122 and the leading roller 124 for purposes of removing debris such as hair. The cover 140 may include a transparent window over at least the brush roll 122 allow visual inspection of the brush roll 122 during use.

The cover 140 includes a bumper 142 that extends out over the leading roller 124 and just in front of the leading roller 124, thereby providing a leading edge. As shown, the bumper 142 may extend laterally along a substantial portion of the front side 112 and downward proximate each of the sides 116*a*, 116*b*. The bumper 142 may be made of a material that is more compliant and flexible than the other material used for the cover 140 to allow the bumper 142 to flex, for example, when contacting a wall surface. In one example, the cover 140 may be made of a hard plastic or polymer material such as polycarbonate (PC) or acrylonitrile-butadiene-styrene (ABS) with the bumper 142 being made of a thermoplastic elastomer such as thermoplastic polyurethane (TPU).

The bumper 142 is configured to seal partially against a vertical surface (e.g., a wall) during use while forming air flow passageways at certain locations to improve front edge cleaning. When contacting the vertical surface, for example, the bumper 142 will direct air through front edge passageways below the sides of the bumper 142. The bumper 142 may also include one or more compression elements 143 (e.g., ribs) that form air passageways. When the bumper 142 is pushed against the vertical surface, the compression elements 143 contact the vertical surface first and push the bumper 142 locally farther back than the rest of the bumper 142, thereby forming a gap on either side of the compression elements 143. The gaps on either side of the compression elements 143 form air paths allowing air to be drawn down in front of the leading roller 124, which may disturb dust and debris so that it can be directed into the air flow path toward the suction conduit opening 111.

The removable cover 140 also includes a seal 144 on an underside of the cover 140 and configured to engage the housing 110 around an upper perimeter of the brush roll chamber 119 for sealing the brush roll chamber 119 at the top side of the housing 110. By sealing the brush roll chamber 119 at the top side, suction and airflow into the suction conduit opening 111 may be improved. The removable cover 140 may be held against the housing 110 securely to maintain the seal. In the illustrated embodiment, the removable cover 140 includes one or more tabs 146*a-c* at a back end of the cover 140 for engaging respective slots 113*a-c* in the housing 110 and one or more protrusions 147 inside the cover 140 at the sides of the front end of the cover 140 for engaging respective latch fingers 150 at the sides 116*a*, 116*b* of the housing 110. The latch fingers 150 may be retracted toward the housing by respective latch actuators 152 to release and remove the cover 140.

Figure 7:
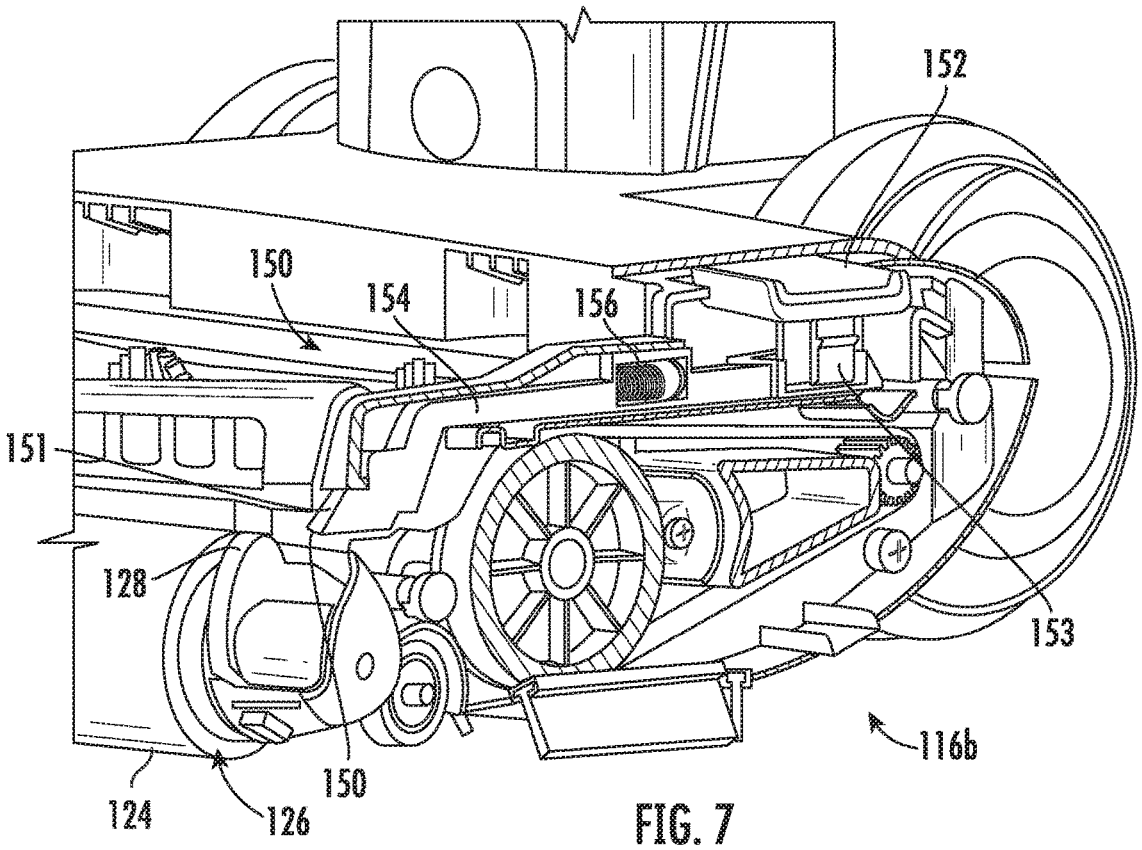
FIG. 7 is an enlarged side view of the surface cleaning head shown in FIG. 1 with a side panel removed to show a latch mechanism used to engage the removable cover.
Figure 8:
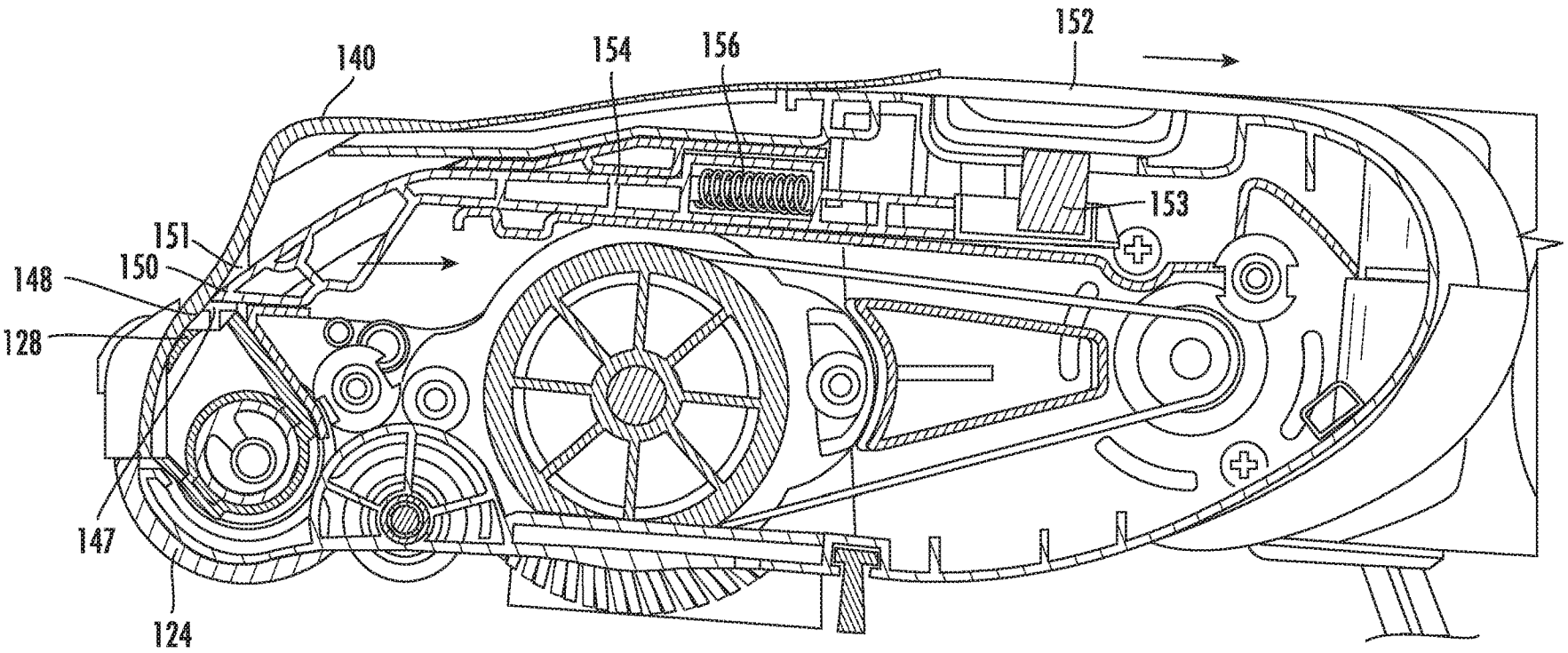
FIG. 8 is a side cross-sectional view the latching mechanism engaging the cover and the cover securing a leading roller.

Referring to FIGS. 7 and 8, an embodiment of the latch mechanism on one side 116*b* is shown and described in greater detail. In this embodiment, the latch finger 150 is at one end of a sliding member 154 and the latch actuator 152 is engaged with the other end of the sliding member 154. The latch actuator 152 includes or is connected to a portion 153 extending downward to engage the sliding member 154. A resilient member 156, such as a spring, biases the sliding member 154 and the latch finger 150 outward and away from the housing 110 and into engagement with the protrusion 147 inside the cover 140. The latch finger 150 may be retracted against the bias of the resilient member 156 by sliding the latch actuator 152 rearward in the direction of the arrow. The latch finger 150 includes an angled top surface 151 to allow the protrusion 147 to slide over the latch finger 150 and push the latch finger 150 rearward against the bias of the resilient member 156 when the cover 140 is moved downward into engagement with the housing 110. When the protrusion 147 moves beyond the latch finger 150, the latch finger 150 will be biased into a position over the protrusion 147 thereby engaging the protrusion 147 and holding the front end of the cover 140. Other types of latch mechanisms are also within the scope of the present disclosure.

Figure 9:
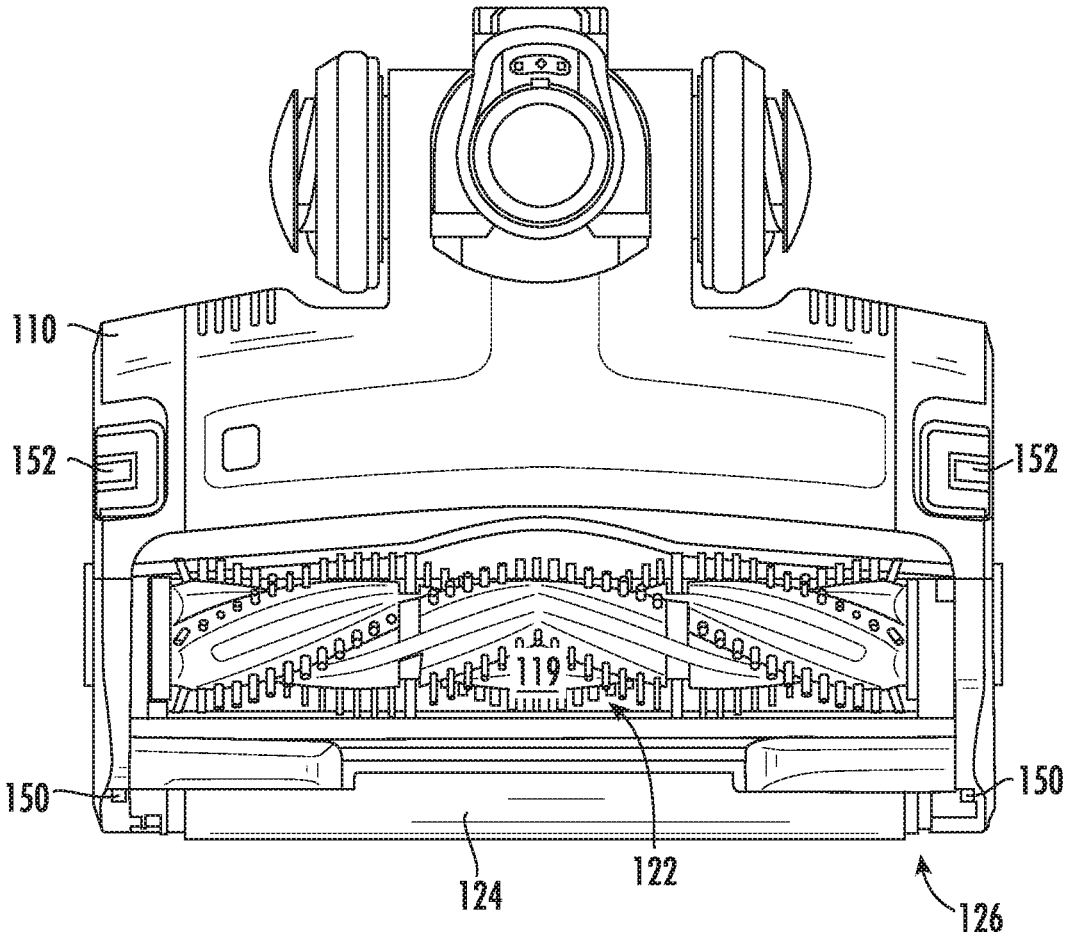
FIG. 9 is a top view of the surface cleaning head shown in FIG. 1 with the removable cover removed.

The latch mechanisms are isolated from the brush roll chamber 119 and thus do not affect the suction into the suction conduit opening 111. In particular, the latch actuator 152 is spaced from the opening to the brush roll chamber 119 as shown in FIG. 9.

In the example embodiment, the leading roller 124 is removable and is held in place by the cover 140. A downwardly extending portion 148 of the cover 142 at one side engages a non-rotating end 126 of the leading roller 124 (see FIGS. 5 and 7). The non-rotating end 126 includes a tab 128 that extends outward and an inside portion of the cover 140 engages the tab 128 when the cover 140 is held in place by the latch mechanism (see FIG. 8). The leading roller 124 may be configured to be removed and may have a driven end and non-driven end, for example, similar to the removable brush roll described in U.S. Patent Application Publication No. 2016/0220082, which is incorporated herein by reference. Although the brush roll 122 in the example embodiment of the surface cleaning head 100 is not removable, the brush roll 122 may also be similarly removable in other embodiments.

Referring to FIGS. 10-13, other embodiments of the surface cleaning head 100 may include a shelf structure 160 at a back side of the brush roll chamber 119. The shelf structure 160 may have various configurations and shapes but includes at least a surface facing generally downward toward the underside 120 of the housing 110 and opposing the rotation of the brush roll 122. As debris circulates around the brush roll chamber 119 by rotation of the brush roll 122, the shelf structure 160 knocks down and de-energizes the debris to facilitate capturing the debris in the air flow through the suction conduit, as shown by the arrows. Although the shelf structure 160 is shown in the illustrated embodiment of the surface cleaning head 100 including dual agitators 122, 124, the shelf structure may also be used in other surface cleaning heads, for example, without a leading roller 124.

Figure 11:
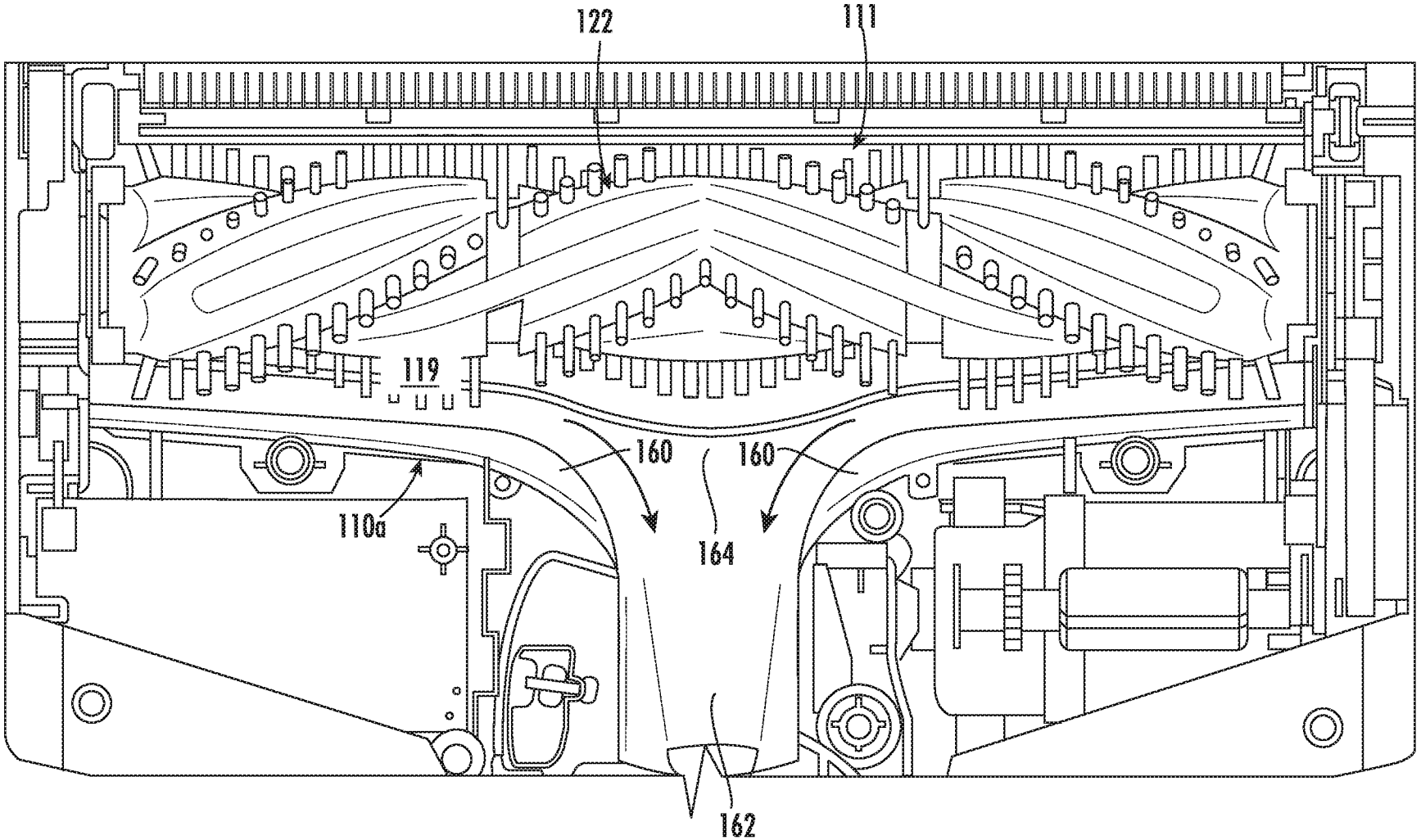
FIG. 11 is a top cross-sectional view of the surface cleaning head taking along line 11-11 in FIG. 10 and further illustrating a shelf structure at a back side of a brush roll chamber.

In this embodiment, a vacuum channel 162 extends from the back side of the brush roll chamber 119 to further define the suction conduit. Thus, the suction conduit passes from the suction conduit opening 111 through a portion of the brush roll chamber 119 and through the vacuum channel 162. The illustrated embodiment of the vacuum channel 162 includes a flared mouth 164 at the intersection with the brush roll chamber 119, which provides a dirty air inlet that receives dirt and debris together with air being drawn through the suction conduit. As shown in FIGS. 10 and 11, the shelf structure 160 may extend into at least a portion of the flared mouth 164 of the vacuum channel 162.

Figure 12:
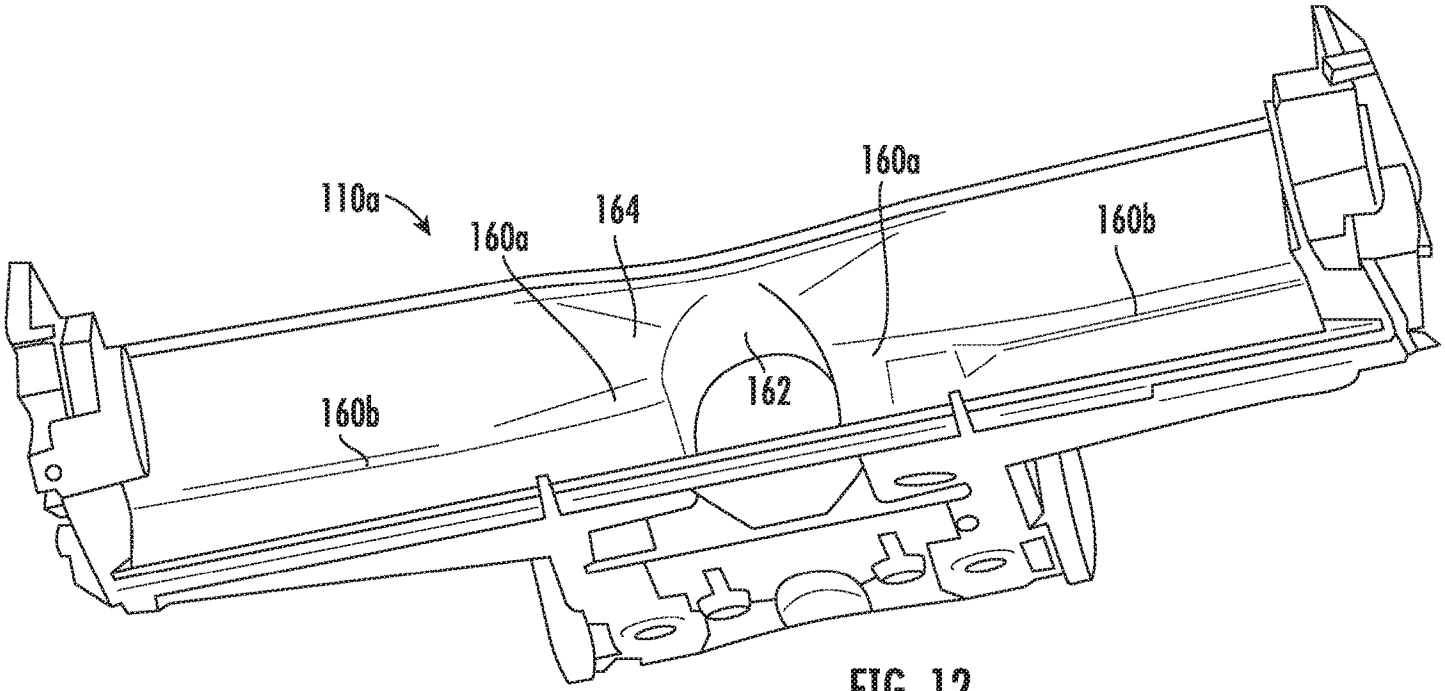
FIG. 12 is a bottom perspective view of a portion of the housing defining the shelf structure in the surface cleaning head.
Figure 13:
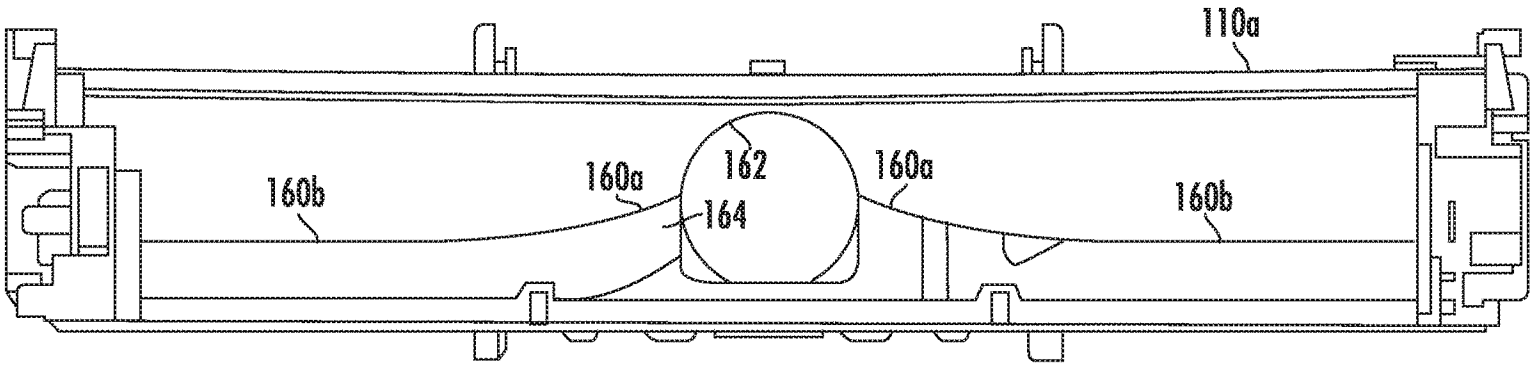
FIG. 13 is a front view of the portion of the housing shown in FIG. 12.

FIGS. 12 and 13 show the portion of the housing 110*a* that defines the back side of the brush roll chamber and the flared mouth 164 of the vacuum channel 162. As shown in FIGS. 12 and 13, the shelf structure 160 may include shelf portions 160*a* extending into the flared mouth 164 and shelf portions 160*b* extending along at least a portion of the back side of the brush roll chamber. The shelf structure 160 may have a depth of about 5-10 mm and a height of about 12-20 mm. The shelf portions 160*a* extending into the flared mouth 164 may be deeper than the shelf portions 160*b* extending along the back side of the brush roll chamber.

Figure 14:
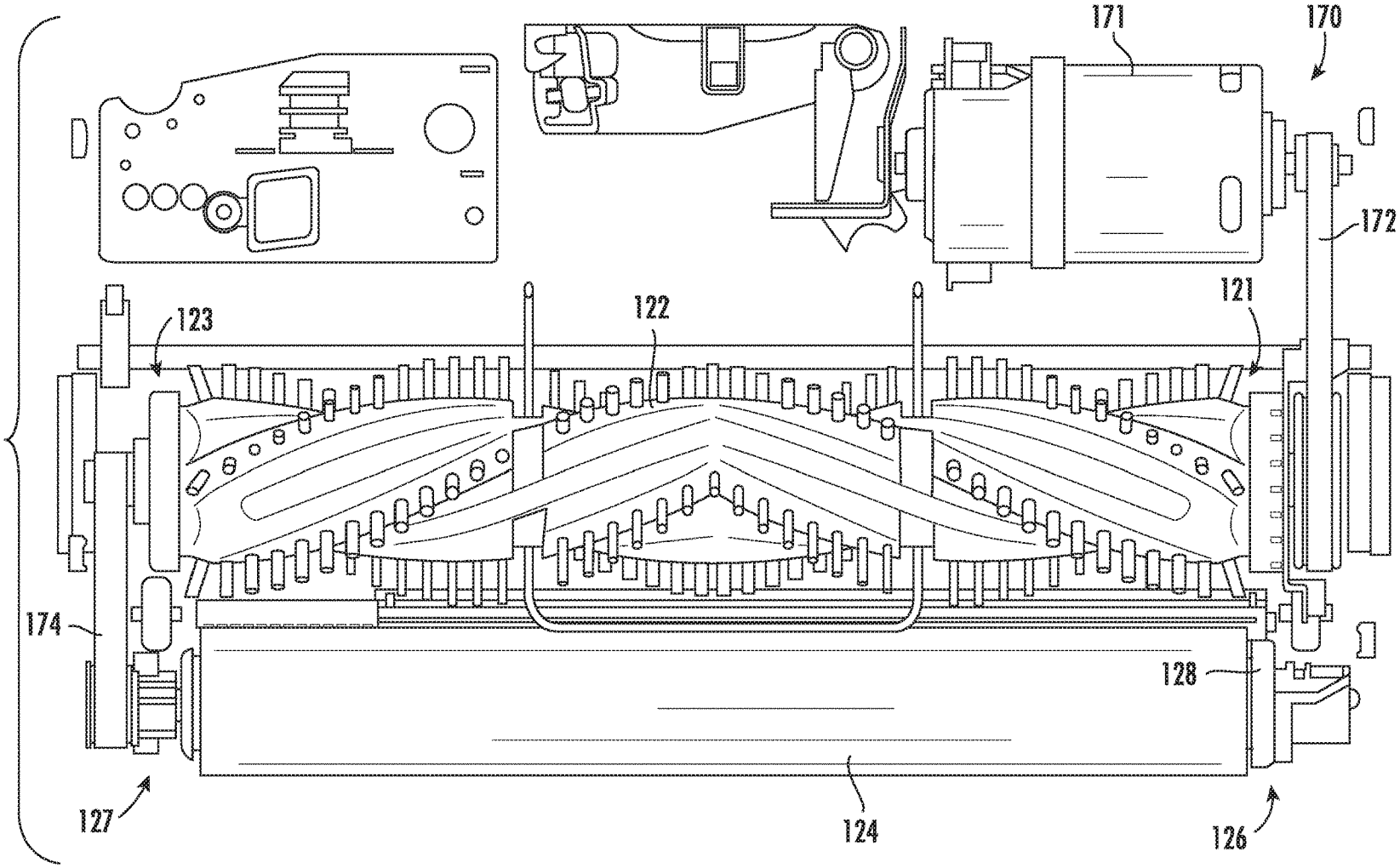
FIG. 14 is a top view of a drive mechanism driving dual agitators for use in the surface cleaning head shown FIG. 1.

Referring to FIG. 14, embodiments of the surface cleaning head 100 may also include driving the brush roll 122 and the leading roller 124 at opposite ends. A drive mechanism 170 directly drives the brush roll 122 at a first brush roll end 121 (e.g., via a first drive belt 172) and the leading roller 124 is driven at a second leading roller end 127 from a second brush roll end 123 of the brush roll 122 (e.g., via a second drive belt 174). The drive mechanism 170 includes a drive motor 171 for providing the rotation and first and second drive belts 172, 174 are used to transfer rotation. In other embodiments, gears may be used to transfer rotation. By driving the leading roller 124 at the opposite end, the leading roller 124 is not required to be offset and may be more centrally located in the housing 110.

Figure 15:
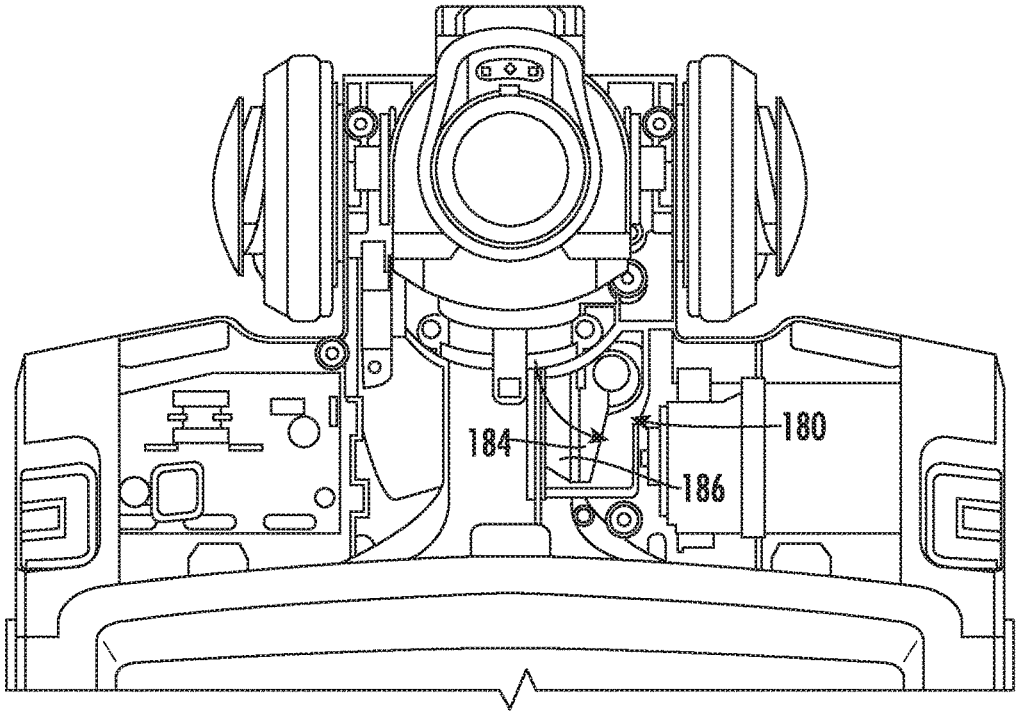
FIG. 15 is a top view of a bleed valve mechanism in the surface cleaning head shown in FIG. 1.
Figure 16:
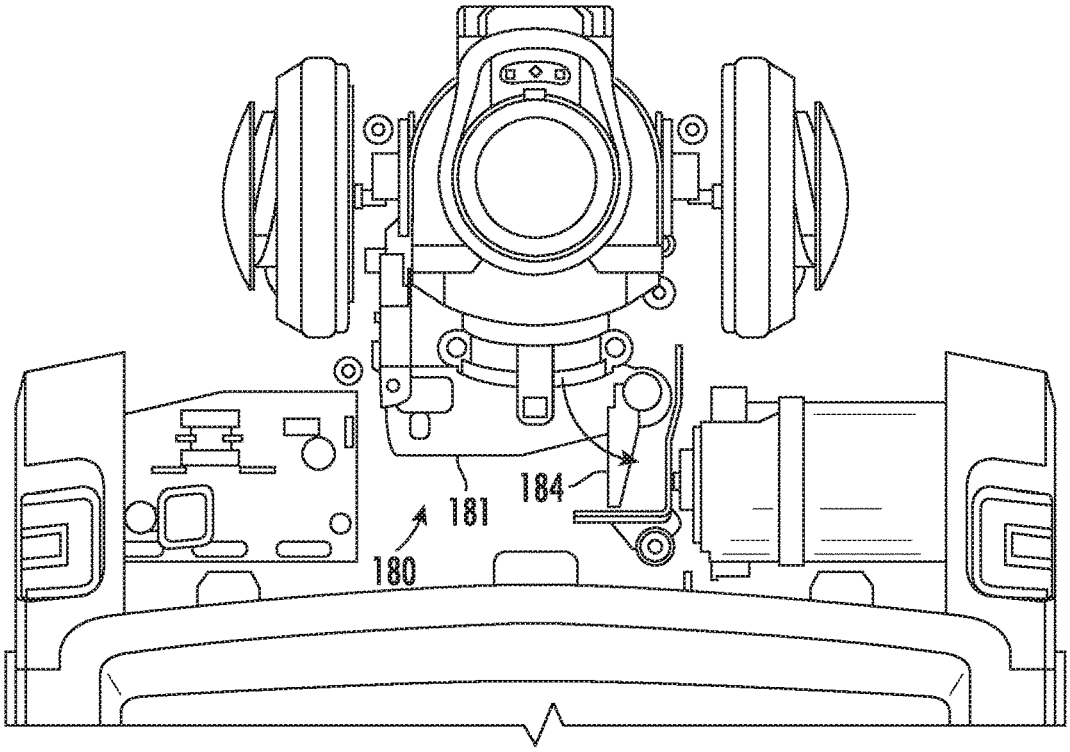
FIG. 16 is a top view of a bleed valve mechanism in the surface cleaning head shown in FIG. 1 and illustrating the bleed valve actuator.

Referring to FIGS. 15 and 16, embodiments of the surface cleaning head 100 may also include a motion-actuated bleed valve 180. The motion-actuated bleed valve 180 includes a pivoting actuator 181 including surface engaging elements 182 (shown in FIGS. 2 and 4), such as stiff bristles, configured to catch on a surface being cleaned during a pull stroke. The pivoting actuator 181 is coupled to a pivoting valve member 184 that covers a port 186 in a side of the vacuum channel 162. The pivoting valve member 184 is biased into a closed position covering the port 186, for example, by a resilient member (not shown) such as a torsion spring. When the surface engaging elements 182 catch on a surface during the pull stroke, the pivoting actuator 181 pivots and causes the valve member 184 to pivot away from the port 186, thereby allowing air to flow or bleed out of the vacuum channel 162. This air flow reduces the suction and makes it easier to pull the surface cleaning head 100 (i.e., when attached to wand of a vacuum cleaner). The bleed valve is useful on heavier upright vacuum cleaners especially with higher suction resulting, for example, from the techniques described herein.

Figure 17:
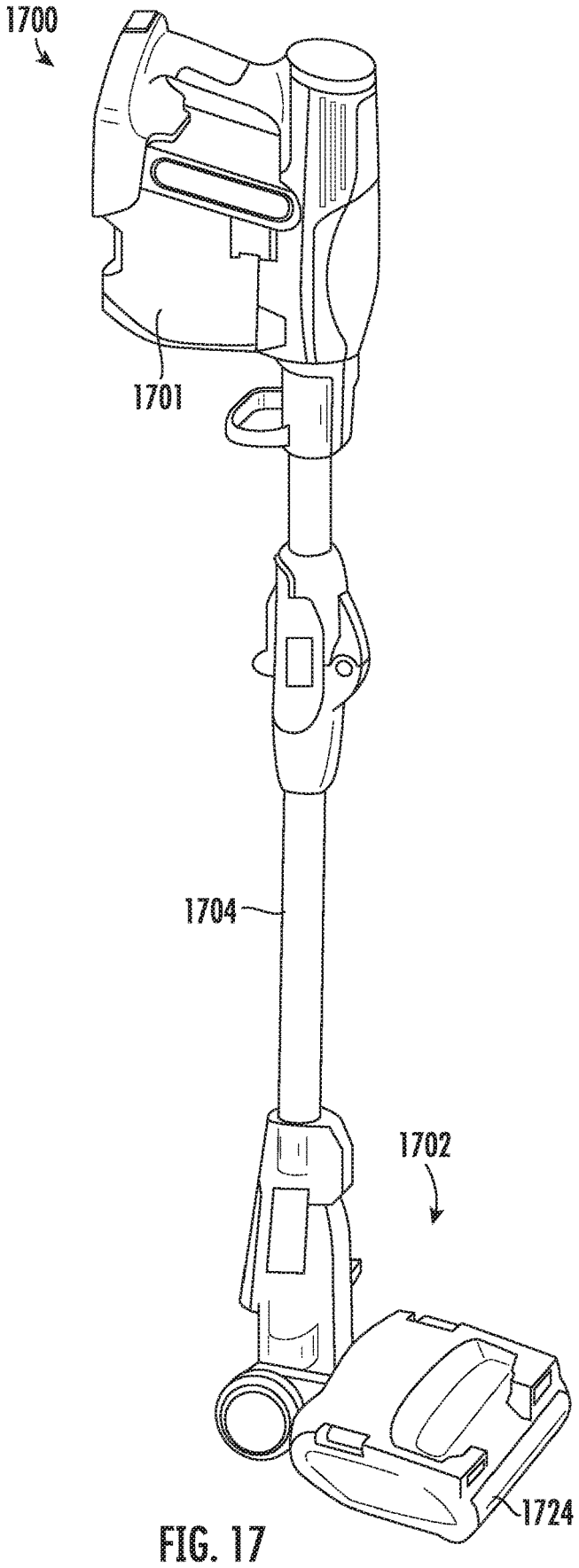
FIG. 17 is a perspective view of a stick vacuum including a surface cleaning head, consistent with embodiments of the present disclosure.

FIG. 17 illustrates one type of vacuum cleaner 1700 that may include a surface cleaning head 1702, consistent with the embodiments described herein. The surface cleaning head 1702 with the leading roller 1724 may be used on a stick type vacuum cleaner 1700 with a removable handheld vacuum 1701 coupled at one end of a wand 1704, such as the type described in U.S. Patent Application Pub. No. 2015/0135474, which is commonly owned and fully incorporated herein by reference. The surface cleaning head with the leading roller may also be used on an upright vacuum cleaner (not shown) with a removable canister coupled to a wand, such as the type described in U.S. Patent Application Pub. No. 2015/0351596, which is commonly owned and fully incorporated herein by reference. A surface cleaning head consistent with embodiments described herein may also be used in a robotic vacuum cleaner such as the type described in U.S. Patent Application Ser. No. 62/511,099, which is commonly owned and fully incorporated herein by reference.

Accordingly, embodiments of a surface cleaning head, consistent with the present disclosure, may be capable of improved suction and air flow, improved front and edge cleaning, improved versatility on both carpets and hard surfaces, improved access to dual agitators for cleaning and removal, and/or improved maneuverability.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A surface cleaning head comprising:

a housing having a front side, a back side, a first lateral side, and a second lateral side, and an underside, the housing further including a suction conduit having an opening on the underside of the housing;

a brush roll rotatably mounted to the housing within a brush roll chamber and having a first brush roll end proximate the first lateral side and a second brush roll end proximate the second lateral side;

a leading roller mounted to the housing in front of the brush roll and having a first leading roller end proximate the first lateral side and a second leading roller end proximate the second lateral side, wherein at least an inside upper portion of the leading roller is not exposed to a primary air flow path into the opening of the suction conduit while at least an inside of a bottom portion of the leading roller is exposed to the primary flow path into the opening of the suction conduit; and a drive mechanism coupled to the first brush roll end for rotating the brush roll, wherein the second brush roll end of the brush roll is coupled to the second leading roller end of the leading roller for transferring rotation from the brush roll to the leading roller, the drive mechanism including a drive motor, wherein the drive mechanism is further configured to cause the brush roll and the leading roller to both rotate in the same direction.

2. The surface cleaning head of claim 1, wherein the drive motor is coupled to the first brush roll end via a first drive belt, and wherein the second brush roll end is coupled to the second leading roller end via a second drive belt.

3. The surface cleaning head of claim 1, wherein the leading roller is centrally located between the first lateral side and the second lateral side.

4. The surface cleaning head of claim 1, further comprising:

the housing defining the brush roll chamber and the suction conduit with the suction conduit opening on the underside of the housing between the front side and the back side, wherein the suction conduit passes from the suction conduit opening through at least a portion of the brush roll chamber; and wherein at least a portion of the brush roll is proximate the opening of the suction conduit.

5. The surface cleaning head of claim 4, further comprising:

a vacuum channel extending from a back side of the brush roll chamber such that the suction conduit passes from the brush roll chamber and into the vacuum channel; and a shelf structure located at the back side of the brush roll chamber, the shelf structure including a surface facing generally downward toward the underside of the housing and opposing rotation of the brush roll, wherein the shelf structure is configured and positioned to knock down and de-energize debris moving at the back side of the brush roll chamber to allow the debris to enter the vacuum channel via air flow through the suction conduit.

6. The surface cleaning head of claim 5, wherein the shelf structure extends at least partially into the vacuum channel.

7. The surface cleaning head of claim 5, wherein the vacuum channel includes a flared mouth at the brush roll chamber, and wherein the shelf structure extends along at least a portion of the flared mouth.

8. The surface cleaning head of claim 7, wherein the shelf structure also extends from the flared mouth along at least a portion of the back side of the brush roll chamber.

9. The surface cleaning head of claim 8, further comprising a rear floor sealing strip along the opening to the suction conduit proximate the back side of the brush roll chamber and first and second side floor sealing strips along at least a portion of the opening to the suction conduit proximate first and second lateral sides of the housing.

10. The surface cleaning head of claim 9, wherein the side floor sealing strips are located proximate the rear floor sealing strip and spaced from the leading roller to form side air passageways to the opening of the suction conduit.

11. A surface cleaning head comprising:

a housing having a front side, a back side, a first lateral side and a second lateral side, the housing defining a brush roll chamber and a suction conduit with a suction conduit opening on an underside of the housing between the front side and the back side, wherein the suction conduit passes through at least a portion of the brush roll chamber;

wheels coupled to the housing for supporting the housing on a surface to be cleaned;

a brush roll rotatably mounted to the housing within the brush roll chamber with at least a portion of the brush roll extending through the suction conduit opening, the brush roll having a first brush roll end proximate the first lateral side and a second brush roll end proximate the second lateral side;

a leading roller mounted to the housing in front of the brush roll and having a first leading roller end proximate the first lateral side and a second leading roller end proximate the second lateral side;

a drive mechanism coupled to the first brush roll end for rotating the brush roll, wherein the second brush roll end of the brush roll is coupled to the second leading roller end of the leading roller for transferring rotation from the brush roll to the leading roller, the drive mechanism including a drive motor at least one floor sealing strip along a rear side of the suction conduit opening and along at least a portion of sides of the suction conduit opening, wherein side air passages are formed between the leading roller and ends of the at least one floor sealing strip on the sides of the suction conduit; and a sole plate on an underside of the housing defining at least a portion of the suction conduit opening, wherein the sole plate has a clearance from the surface to be cleaned when the wheels are supported on the surface to be cleaned, wherein the brush roll extends beyond the sole plate less than or equal to the clearance and wherein the at least one floor sealing strip extends greater than the clearance.

12. The surface cleaning head of claim 11, wherein the drive motor is coupled to the first brush roll end via a first drive belt, and wherein the second brush roll end is coupled to the second leading roller end via a second drive belt.

13. The surface cleaning head of claim 11, wherein the leading roller is centrally located between the first lateral side and the second lateral side.

14. The surface cleaning head of claim 11, wherein the at least one floor sealing strip includes at least one bristle strip.

15. The surface cleaning head of claim 14, wherein the bristle strip includes bristles and a strip of another material extending along the bristle strip between the bristles.

16. The surface cleaning head of claim 15, wherein the leading roller has a smaller diameter than the brush roll.

17. The surface cleaning head of claim 16, wherein the at least one floor sealing strip includes a rear sealing strip along a rear side of the suction conduit opening and side floor sealing strips along at least a portion of sides of the suction conduit opening.

* * * * *